US008087117B2

(12) United States Patent
Kapoor et al.

(10) Patent No.: US 8,087,117 B2
(45) Date of Patent: Jan. 3, 2012

(54) CLEANING ROBOT ROLLER PROCESSING

(75) Inventors: Deepak Ramesh Kapoor, Cupertino, CA (US); Zivthan A. Dubrovsky, Waltham, MA (US)

(73) Assignee: iRobot Corporation, Bedford, MA (US)

( * ) Notice: Subject to any disclaimer, the term of this patent is extended or adjusted under 35 U.S.C. 154(b) by 945 days.

(21) Appl. No.: 11/751,413

(22) Filed: May 21, 2007

(65) Prior Publication Data

US 2008/0052846 A1 Mar. 6, 2008

Related U.S. Application Data

(60) Provisional application No. 60/747,791, filed on May 19, 2006, provisional application No. 60/803,504, filed on May 30, 2006, provisional application No. 60/807,442, filed on Jul. 14, 2006.

(51) Int. Cl.
*A47L 11/00* (2006.01)
*A47L 11/24* (2006.01)

(52) U.S. Cl. ..... 15/52.1; 15/3; 15/48; 15/256.51; 15/256.53

(58) Field of Classification Search ..... 15/21.1, 15/3, 97.1, 319, 378, 383, 392, 393, 403, 15/38; 901/1; *A47L 5/00*
See application file for complete search history.

(56) References Cited

U.S. PATENT DOCUMENTS 2,770,825 A * 11/1956 Pullen ..... 15/48
3,457,575 A 7/1969 Bienek
3,550,714 A 12/1970 Bellinger
3,674,316 A 7/1972 De Brey
3,863,285 A 2/1975 Hukuba
3,898,311 A 8/1975 Mitchell et al.
3,937,174 A 2/1976 Haaga
4,099,284 A 7/1978 Shinozaki et al.
4,119,900 A 10/1978 Kremnitz
4,175,892 A 11/1979 De brey
4,306,329 A 12/1981 Yokoi
4,369,543 A 1/1983 Chen et al.

(Continued)

FOREIGN PATENT DOCUMENTS

DE 44 14 683 10/1995

(Continued)

OTHER PUBLICATIONS

Cameron Morland, *Autonomous Lawn Mower Control*, Jul. 24, 2002.

(Continued)

*Primary Examiner* — Monica Carter
*Assistant Examiner* — Stephanie Newton
(74) *Attorney, Agent, or Firm* — Fish & Richardson P.C.

(57) ABSTRACT

A coverage robot includes a chassis, a drive system, and a cleaning assembly. The cleaning assembly includes a housing and at least one driven cleaning roller including an elongated core with end mounting features defining a central longitudinal axis of rotation, multiple floor cleaning bristles extending radially outward from the core, and at least one compliant flap extending radially outward from the core to sweep a floor surface. The flap is configured to prevent errant filaments from spooling tightly about the core to aid subsequent removal of the filaments. In another aspect, a coverage robot includes a chassis, a drive system, a controller, and a cleaning assembly. The cleaning assembly includes a housing and at least one driven cleaning roller. The coverage robot includes a roller cleaning tool carried by the chassis and configured to longitudinally traverse the roller to remove accumulated debris from the cleaning roller.

19 Claims, 26 Drawing Sheets

U.S. PATENT DOCUMENTS

| | | | |
|---|---|---|---|
| 4,401,909 | A | 8/1983 | Gorsek |
| 4,513,469 | A | 4/1985 | Godfrey et al. |
| 4,626,995 | A | 12/1986 | Lofgren et al. |
| 4,674,048 | A | 6/1987 | Okumura |
| 4,679,152 | A | 7/1987 | Perdue |
| 4,696,074 | A | 9/1987 | Cavalli et al. |
| 4,700,427 | A | 10/1987 | Knepper |
| 4,716,621 | A | 1/1988 | Zoni |
| 4,733,430 | A | 3/1988 | Westergren |
| 4,733,431 | A | 3/1988 | Martin |
| 4,756,049 | A | 7/1988 | Uehara |
| 4,777,416 | A | 10/1988 | George, II et al. |
| 4,782,550 | A | 11/1988 | Jacobs |
| 4,815,157 | A | 3/1989 | Tsuchiya |
| 4,854,000 | A | 8/1989 | Takimoto |
| 4,887,415 | A | 12/1989 | Martin |
| 4,901,394 | A | 2/1990 | Nakamura et al. |
| 4,919,224 | A | 4/1990 | Shyu et al. |
| 4,933,864 | A | 6/1990 | Evans et al. |
| 4,956,891 | A | 9/1990 | Wulff |
| 4,962,453 | A | 10/1990 | Pong et al. |
| 4,974,283 | A | 12/1990 | Holsten et al. |
| 5,002,145 | A | 3/1991 | Waqkaumi et al. |
| 5,049,802 | A | 9/1991 | Mintus et al. |
| 5,086,535 | A | 2/1992 | Grossmeyer et al. |
| 5,093,955 | A | 3/1992 | Blehert et al. |
| 5,105,502 | A | 4/1992 | Takashima |
| 5,109,566 | A | 5/1992 | Kobayashi et al. |
| 5,115,538 | A | 5/1992 | Cochran et al. |
| 5,136,750 | A | 8/1992 | Takashima et al. |
| 5,163,202 | A | 11/1992 | Kawakami et al. |
| 5,204,814 | A | 4/1993 | Noonan et al. |
| 5,233,682 | A | 8/1993 | Abe et al. |
| 5,239,720 | A | 8/1993 | Wood et al. |
| 5,251,358 | A | 10/1993 | Moro et al. |
| 5,261,139 | A | 11/1993 | Lewis |
| 5,279,672 | A | 1/1994 | Betker, Jr. et al. |
| 5,284,522 | A | 2/1994 | Kobayashi et al. |
| 5,293,955 | A | 3/1994 | Lee |
| 5,303,448 | A | 4/1994 | Hennessey et al. |
| 5,315,227 | A | 5/1994 | Pierson et al. |
| 5,319,827 | A | 6/1994 | Yang |
| 5,319,828 | A | 6/1994 | Waldhauser et al. |
| 5,321,614 | A | 6/1994 | Ashworth |
| 5,324,948 | A | 6/1994 | Dudar et al. |
| 5,341,540 | A | 8/1994 | Soupert et al. |
| 5,345,649 | A | 9/1994 | Whitlow |
| 5,353,224 | A | 10/1994 | Lee et al. |
| 5,369,347 | A | 11/1994 | Yoo |
| 5,440,216 | A | 8/1995 | Kim |
| 5,444,965 | A | 8/1995 | Colens |
| 5,446,356 | A | 8/1995 | Kim |
| 5,454,129 | A | 10/1995 | Kell |
| 5,455,982 | A | 10/1995 | Armstrong et al. |
| 5,465,525 | A | 11/1995 | Mifune et al. |
| 5,467,273 | A | 11/1995 | Faibish et al. |
| 5,497,529 | A | 3/1996 | Boesi |
| 5,498,948 | A | 3/1996 | Bruni et al. |
| 5,507,067 | A | 4/1996 | Hoekstra et al. |
| 5,515,572 | A | 5/1996 | Hoekstra et al. |
| 5,534,762 | A | 7/1996 | Kim |
| 5,537,017 | A | 7/1996 | Feiten et al. |
| 5,539,953 | A | 7/1996 | Kurz |
| 5,542,146 | A | 8/1996 | Hoekstra et al. |
| 5,548,511 | A | 8/1996 | Bancroft |
| 5,553,349 | A | 9/1996 | Kilstrom et al. |
| 5,555,587 | A | 9/1996 | Guha |
| 5,560,077 | A | 10/1996 | Crotchett |
| 5,568,589 | A | 10/1996 | Hwang |
| 5,608,944 | A | 3/1997 | Gordon |
| 5,611,106 | A | 3/1997 | Wulff |
| 5,611,108 | A | 3/1997 | Knowlton et al. |
| 5,613,261 | A | 3/1997 | Kawakami et al. |
| 5,621,291 | A | 4/1997 | Lee |
| 5,622,236 | A | 4/1997 | Azumi et al. |
| 5,634,237 | A | 6/1997 | Paranjpe |
| 5,634,239 | A | 6/1997 | Tuvin et al. |
| 5,650,702 | A | 7/1997 | Azumi |
| 5,652,489 | A | 7/1997 | Kawakami |
| 5,682,313 | A | 10/1997 | Edlund et al. |
| 5,709,007 | A | 1/1998 | Chiang |
| 5,761,762 | A | 6/1998 | Kubo et al. |
| 5,781,960 | A | 7/1998 | Kilstrom et al. |
| 5,787,545 | A | 8/1998 | Colens |
| 5,794,297 | A | 8/1998 | Muta |
| 5,815,884 | A | 10/1998 | Imamura et al. |
| 5,839,156 | A | 11/1998 | Park et al. |
| 5,841,259 | A | 11/1998 | Kim et al. |
| 5,867,800 | A | 2/1999 | Leif |
| 5,910,700 | A | 6/1999 | Crotzer |
| 5,926,909 | A | 7/1999 | McGee |
| 5,935,179 | A | 8/1999 | Kleiner et al. |
| 5,940,927 | A | 8/1999 | Haegermarck et al. |
| 5,940,930 | A | 8/1999 | Oh et al. |
| 5,943,730 | A | 8/1999 | Boomgaarden |
| 5,943,733 | A | 8/1999 | Tagliaferri |
| 5,959,423 | A | 9/1999 | Nakanishi et al. |
| 6,023,814 | A | 2/2000 | Imamura |
| 6,041,471 | A | 3/2000 | Charky et al. |
| 6,076,226 | A | 6/2000 | Reed |
| 6,094,775 | A | 8/2000 | Behmer |
| 6,444,003 | B1 | 9/2002 | Sutcliffe |
| 6,496,754 | B2 | 12/2002 | Song et al. |
| 6,496,755 | B2 | 12/2002 | Wallach et al. |
| 6,525,509 | B1 | 2/2003 | Petersson et al. |
| 6,532,404 | B2 | 3/2003 | Colens |
| 6,571,415 | B2 | 6/2003 | Gerber et al. |
| 6,571,422 | B1 | 6/2003 | Gordon et al. |
| 6,574,536 | B1 | 6/2003 | Kawagoe et al. |
| 6,580,246 | B2 | 6/2003 | Jacobs |
| 6,586,908 | B2 | 7/2003 | Petersson et al. |
| 6,605,156 | B1 | 8/2003 | Clark et al. |
| 6,611,120 | B2 | 8/2003 | Song et al. |
| 6,611,738 | B2 | 8/2003 | Ruffner |
| 6,658,693 | B1 | 12/2003 | Reed, Jr. |
| 6,671,592 | B1 | 12/2003 | Bisset et al. |
| 6,690,134 | B1 | 2/2004 | Jones et al. |
| 6,732,826 | B2 | 5/2004 | Song et al. |
| 6,741,054 | B2 | 5/2004 | Koselka et al. |
| 6,748,297 | B2 | 6/2004 | Song et al. |
| 6,764,373 | B1 | 7/2004 | Osawa et al. |
| 6,781,338 | B2 | 8/2004 | Jones et al. |
| 6,809,490 | B2 | 10/2004 | Jones et al. |
| 6,830,120 | B1 | 12/2004 | Yashima et al. |
| 6,841,963 | B2 | 1/2005 | Song et al. |
| 6,883,201 | B2 * | 4/2005 | Jones et al. ..... 15/319 |
| 6,901,624 | B2 | 6/2005 | Mori et al. |
| D510,066 | S | 9/2005 | Hickey et al. |
| 6,938,298 | B2 | 9/2005 | Aasen |
| 6,956,348 | B2 | 10/2005 | Landry et al. |
| 6,965,209 | B2 | 11/2005 | Jones et al. |
| 6,968,592 | B2 | 11/2005 | Takeuchi et al. |
| 6,971,140 | B2 | 12/2005 | Kim |
| 6,999,850 | B2 | 2/2006 | McDonald |
| 7,024,278 | B2 | 4/2006 | Chiappetta et al. |
| 7,053,578 | B2 | 5/2006 | Diehl et al. |
| 7,055,210 | B2 | 6/2006 | Keppler et al. |
| 7,085,624 | B2 | 8/2006 | Aldred et al. |
| 7,206,677 | B2 | 4/2007 | Hulden |
| 7,225,500 | B2 | 6/2007 | Diehl et al. |
| 2001/0047231 | A1 | 11/2001 | Peless et al. |
| 2002/0011813 | A1 | 1/2002 | Koselka et al. |
| 2002/0016649 | A1 | 2/2002 | Jones |
| 2002/0120364 | A1 | 8/2002 | Colens |
| 2002/0124343 | A1 | 9/2002 | Reed |
| 2002/0156556 | A1 | 10/2002 | Ruffner |
| 2002/0173877 | A1 | 11/2002 | Zweig |
| 2003/0019071 | A1 | 1/2003 | Field et al. |
| 2003/0025472 | A1 | 2/2003 | Jones et al. |
| 2003/0060928 | A1 | 3/2003 | Abramson et al. |
| 2003/0120389 | A1 | 6/2003 | Abramson et al. |
| 2003/0137268 | A1 | 7/2003 | Papanikolopoulos et al. |
| 2003/0192144 | A1 | 10/2003 | Song et al. |
| 2003/0216834 | A1 | 11/2003 | Allard |
| 2003/0233177 | A1 | 12/2003 | Johnson et al. |
| 2004/0020000 | A1 | 2/2004 | Jones |
| 2004/0030448 | A1 | 2/2004 | Solomon |

| | | | | |
|---|---|---|---|---|
| 2004/0030449 | A1 | 2/2004 | Solomon | |
| 2004/0030450 | A1 | 2/2004 | Solomon | |
| 2004/0030571 | A1 | 2/2004 | Solomon | |
| 2004/0031113 | A1 | 2/2004 | Wosewick et al. | |
| 2004/0049877 | A1 | 3/2004 | Jones et al. | |
| 2004/0068351 | A1 | 4/2004 | Solomon | |
| 2004/0068415 | A1 | 4/2004 | Solomon | |
| 2004/0068416 | A1 | 4/2004 | Solomon | |
| 2004/0074044 | A1 | 4/2004 | Diehl et al. | |
| 2004/0076324 | A1 | 4/2004 | Burl et al. | |
| 2004/0088079 | A1 | 5/2004 | Lavarec et al. | |
| 2004/0111184 | A1 | 6/2004 | Chiappetta et al. | |
| 2004/0134336 | A1 | 7/2004 | Solomon | |
| 2004/0134337 | A1 | 7/2004 | Solomon | |
| 2004/0156541 | A1 | 8/2004 | Jeon et al. | |
| 2004/0158357 | A1 | 8/2004 | Lee et al. | |
| 2004/0200505 | A1 | 10/2004 | Taylor et al. | |
| 2004/0204792 | A1 | 10/2004 | Taylor et al. | |
| 2004/0211444 | A1 | 10/2004 | Taylor et al. | |
| 2004/0236468 | A1 | 11/2004 | Taylor et al. | |
| 2004/0244138 | A1 | 12/2004 | Taylor et al. | |
| 2004/0255425 | A1 | 12/2004 | Arai et al. | |
| 2005/0000543 | A1 | 1/2005 | Taylor et al. | |
| 2005/0010331 | A1 | 1/2005 | Taylor et al. | |
| 2005/0150519 | A1 | 7/2005 | Keppler et al. | |
| 2005/0156562 | A1 | 7/2005 | Cohen et al. | |
| 2005/0183229 | A1* | 8/2005 | Uehigashi | 15/319 |
| 2005/0204717 | A1* | 9/2005 | Colens | 56/344 |
| 2006/0037170 | A1 | 2/2006 | Shimizu | |
| 2006/0060216 | A1 | 3/2006 | Woo et al. | |
| 2007/0157415 | A1 | 7/2007 | Lee et al. | |
| 2007/0157420 | A1 | 7/2007 | Lee et al. | |
| 2007/0226949 | A1 | 10/2007 | Hahm et al. | |
| 2008/0052846 | A1 | 3/2008 | Kapoor et al. | |
| 2009/0049640 | A1 | 2/2009 | Lee et al. | |
| 2010/0011529 | A1 | 1/2010 | Won et al. | |
| 2010/0107355 | A1 | 5/2010 | Won et al. | |

FOREIGN PATENT DOCUMENTS

| | | | |
|---|---|---|---|
| DE | 10242257 | | 4/2003 |
| DE | 102004038074 | | 6/2005 |
| DE | 102004041021 | | 8/2005 |
| EP | 1 331 537 | A1 | 7/2003 |
| EP | 1 331 537 | B1 | 7/2003 |
| EP | 1380245 | | 1/2004 |
| EP | 1557730 | | 7/2005 |
| ES | 2 238 196 | | 8/2005 |
| FR | 2 828 589 | | 8/2001 |
| GB | 702 426 | | 1/1954 |
| GB | 2 283 838 | | 5/1995 |
| JP | 62-120510 | | 6/1987 |
| JP | 62-154008 | | 7/1987 |
| JP | 62154008 | | 7/1987 |
| JP | 63-183032 | | 7/1988 |
| JP | 63-241610 | | 10/1988 |
| JP | 2-6312 | | 1/1990 |
| JP | 03-051023 | | 3/1991 |
| JP | 06-038912 | | 2/1994 |
| JP | 06-327598 | | 11/1994 |
| JP | 7-295636 | | 11/1995 |
| JP | 08-089451 | | 4/1996 |
| JP | 08-152916 | | 6/1996 |
| JP | 9-179625 | | 7/1997 |
| JP | 9185410 | | 7/1997 |
| JP | 11-508810 | | 8/1999 |
| JP | 11-510935 | | 9/1999 |
| JP | 2001-258807 | | 9/2001 |
| JP | 2001-275908 | | 10/2001 |
| JP | 2001-525567 | | 12/2001 |
| JP | 2002-78650 | | 3/2002 |
| JP | 2002-204768 | | 7/2002 |
| JP | 2002-532178 | | 10/2002 |
| JP | 3356170 | | 10/2002 |
| JP | 2002-323925 | | 11/2002 |
| JP | 2002-355206 | | 12/2002 |
| JP | 2002-360471 | | 12/2002 |
| JP | 2002-360482 | | 12/2002 |
| JP | 2003-10076 | | 1/2003 |
| JP | 2003-5296 | | 2/2003 |
| JP | 2003-036116 | | 2/2003 |
| JP | 2003-38401 | | 2/2003 |
| JP | 2003-38402 | | 2/2003 |
| JP | 2003-505127 | | 2/2003 |
| JP | 2003036116 | | 2/2003 |
| JP | 2003-061882 | | 3/2003 |
| JP | 2003 180587 | | 7/2003 |
| JP | 2003-310489 | | 11/2003 |
| WO | WO 95/26512 | | 10/1995 |
| WO | WO95/30887 | | 11/1995 |
| WO | WO 97/15224 | | 5/1997 |
| WO | WO 97/40734 | | 11/1997 |
| WO | WO 97/41451 | | 11/1997 |
| WO | WO 99/28800 | | 6/1999 |
| WO | WO 99/38056 | | 7/1999 |
| WO | WO 99/38237 | | 7/1999 |
| WO | WO 99/43250 | | 9/1999 |
| WO | WO 00/04430 | | 1/2000 |
| WO | WO 00/36962 | | 6/2000 |
| WO | WO 00/38026 | | 6/2000 |
| WO | WO 00/78410 | | 12/2000 |
| WO | WO 01/06904 | | 2/2001 |
| WO | WO 01/06905 | | 2/2001 |
| WO | WO 02/39864 | | 5/2002 |
| WO | WO 02/39868 | | 5/2002 |
| WO | WO 02/058527 | | 8/2002 |
| WO | WO 02/062194 | | 8/2002 |
| WO | WO 02/067744 | | 9/2002 |
| WO | WO 02/067745 | | 9/2002 |
| WO | WO 02/071175 | | 9/2002 |
| WO | WO 02/074150 | | 9/2002 |
| WO | WO 02/075356 | | 9/2002 |
| WO | WO 02/075469 | | 9/2002 |
| WO | WO 02/075470 | | 9/2002 |
| WO | WO 02/101477 | | 12/2002 |
| WO | WO 03/026474 | | 4/2003 |
| WO | WO 03/040845 | | 5/2003 |
| WO | WO 03/040846 | | 5/2003 |
| WO | WO 2004/006034 | | 1/2004 |
| WO | WO 2004004533 | A1 | 1/2004 |
| WO | WO 2004058028 | A2 | 1/2004 |
| WO | WO 2004/058028 | | 7/2004 |
| WO | WO 2004/059409 | | 7/2004 |
| WO | WO 2005/055795 | | 6/2005 |
| WO | WO2005/055795 | | 6/2005 |
| WO | WO 2005077244 | A1 | 8/2005 |
| WO | WO 2006/061133 | | 6/2006 |
| WO | WO 06068403 | A1 | 6/2006 |

OTHER PUBLICATIONS

Doty, Keith L et al, "Sweep Strategies for a Sensory-Driven, Behavior-Based Vacuum Cleaning Agent" AAA1 1993 Fall Symposium Series Instantiating Real-World Agents Research Triangle Park, Raleigh, NC, Oct. 22-24, 1993, pp. 1-6.

Electrolux designed for the well-lived home, website: http://www.electroluxusa.com/node57.as[?currentURL=node142.asp%3F, acessed Mar. 18, 2005.

eVac Robotic Vacuum S1727 Instruction Manual, Sharper Image Corp, Copyright 2004.

Everyday Robots, website: http://www.everydayrobots.com/index.php?option=content&task=view&id=9, accessed Apr. 20, 2005.

Facts on the Trilobite webpage: "http://trilobiteelectroluxse/presskit_en/node11335asp=print=yes&pressID=" accessed Dec. 12, 2003.

Friendly Robotics Robotic Vacuum RV400-The Robot Store website: http://www.therobotstore.com/s.nl/sc.9/category,-109/it.A/id.43/.f, accessed Apr. 20, 2005.

Gat, Erann, Robust Low-computation Sensor-driven Control for Task-Directed Navigation, Proceedings of the 1991 IEEE, International Conference on Robotics and Automation, Sacramento, California, Apr. 1991, pp. 2484-2489.

Hitachi: News release: The home cleaning robot of the autonomous movement type (experimental machine) is developed, website: http://www.i4u.com/japanreleases/hitachirobot.htm., accessed Mar. 18, 2005.

Kärcher Product Manual Download webpage: "http://ww-wkarchercom/bta/downloadenshtml?ACTION=SELECTTEILENR&ID=rc3000&submitButtonName=Select+Product+Manual" and associated pdf file "5959-915enpdf (47 MB) English/English" accessed Jan. 21, 2004.
Karcher RC 3000 Cleaning Robot—user manual Manufacturer: Alfred-Karcher GmbH & Co, Cleaning Systems, Alfred Karcher-Str 28-40, PO Box 160, D-71349 Winnenden, Germany, Dec. 2002.
Kärcher RoboCleaner RC 3000 Product Details webpages: "http://wwwrobocleanerde/english/screen3html" through " . . . screen6html" accessed Dec. 12, 2003.
Karcher USA, RC3000 Robotic Cleaner, website: http://www.karcher-usa.com/showproducts.php?op=view_prod&param1=143&param2=&param3=, accessed Mar. 18, 2005.
Koolvac Robotic Vacuum Cleaner Owner's Manual, Koolatron, Undated.
NorthStar Low-Cost, Indoor Localization, Evolution robotics, Powering Intelligent Products.
Put Your Roomba . . . on "Automatic" Roomba Timer> Timed Cleaning-Floorvac Robotic Vacuum webpages: http://cgi.ebay.com/ws/eBayISAPI.dll?ViewItem&category=43575198387&rd=1, accessed Apr. 20, 2005.
Put Your Roomba . . . on "Automatic" webpages: "http://www.acomputeredge.com/roomba," accessed Apr. 20, 2005.
RoboMaid Sweeps Your Floors So You Won't Have To, the Official Site, website: http://www.thereobomaid.com/, acessed Mar. 18, 2005.
Robot Review Samsung Robot Vacuum (VC-RP30W), website: http://www.onrobo.com/reviews/At_Home/Vacuun_Cleaners/on00vcrp30rosam/index.htm, accessed Mar. 18, 2005.
Robotic Vacuum Cleaner-Blue, website: http://www.sharperimage.com/us/en/catalog/productview.jhtml?sku=S1727BLU, accessed Mar. 18, 2005.
Schofield, Monica, "Neither Master nor Slave" A Practical Study in the Development and Employment of Cleaning Robots, Emerging Technologies and Factory Automation, 1999 Proceedings EFA'99 1999 7th IEEE International Conference on Barcelona, Spain Oct. 18-21, 1999, pp. 1427-1434.
Wired News: Robot Vacs Are in the House, website: http://www.wired.com/news/print/0,1294,59237,00.html, accessed Mar. 18, 2005.
Zoombot Remote Controlled Vaccum-RV-500 New Roomba 2, website: http://cgi.ebay.com/ws/eBayISAPI.dll?ViewItem&category=43526&item=4373497618&rd=1, accessed Apr. 20, 2005.
Search Report in counterpart application PCT/US2007/069389 dated Feb. 14, 2008.
International Preliminary Report on Patentability in corresponding application PCT/US2007/069389, dated Nov. 4, 2008.
Examination report in counterpart U.S. Appl. No. 11/751,470 dated May 27, 2010.
Examination report in counterpart U.S. Appl. No. 11/751,470 dated Feb. 18, 2011.
Examination report in counterpart U.S. Appl. No. 11/751,267 dated Apr. 13, 2010.
Examination report in counterpart U.S. Appl. No. 11/751,267 dated Dec. 2, 2010.
Examination report in counterpart U.S. Appl. No. 11/834,656 dated Jul. 28, 2008.
Examination report in counterpart U.S. Appl. No. 11/834,656 dated Jan. 26, 2009.
Examination report in counterpart U.S. Appl. No. 11/834,606 dated Feb. 28, 2008.
Examination report in counterpart U.S. Appl. No. 11/834,647 dated May 16, 2008.
Examination report in counterpart U.S. Appl. No. 11/834,647 date Oct. 31, 2008.
Examination report in counterpart U.S. Appl. No. 11/834,647 date Mar. 6, 2009.
Examination report in counterpart U.S. Appl. No. 11/834,647 date Sep. 9, 2009.
Examination report in counterpart U.S. Appl. No. 10/818,073 dated May 7, 2008.
Examination report in counterpart U.S. Appl. No. 10/818,073 dated Jan. 7, 2009.
Prassler et al., A Short History of Cleaning Robots, Autonomous Robots 9, 211-226, 2000, 16 pages.
Examination report dated Jul. 15, 2011 from corresponding U.S. Appl. No. 12/687,464.
Examination report dated Aug. 17, 2010 from corresponding application EP 07783998.3.

* cited by examiner

STEP 1: homing and approach

STEP 2: docking

STEP 3: drop cartridge

STEP 4 swap clean/dirty cartridge

STEP 5: load cartridge

STEP 6: undock and resume cleaning

CLEANING ROBOT ROLLER PROCESSING

CROSS-REFERENCE TO RELATED APPLICATIONS

This U.S. patent application claims priority under 35 U.S.C. §119(e) to U.S. provisional patent applications 60/747,791, filed on May 19, 2006, 60/803,504, filed on May 30, 2006, and 60/807,442, filed on Jul. 14, 2006. The entire contents of the aforementioned applications are hereby incorporated by reference.

TECHNICAL FIELD

The disclosure relates to coverage robots, cleaning rollers, and roller cleaning systems.

BACKGROUND

Sweeping and/or vacuuming may be performed by ordinary cleaners (vacuum cleaners, carpet sweepers) or mobile robots that sweep and/or vacuum. These cleaners and robots may include brush or beater rollers that pick up or help pick up debris. However, while such cleaners or mobile robots may include brush or beater rollers to agitate or sweep debris and dirt away from the floor (or other flat surface), filaments (i.e., hair, thread, string, carpet fiber) may become tightly wrapped around the roller. In particular, pet hair tends to accumulate rapidly and resist removal.

SUMMARY

In one aspect, a coverage robot includes a chassis, a drive system mounted on the chassis and configured to maneuver the robot, and a cleaning assembly carried by the chassis. The cleaning assembly includes a cleaning assembly housing and at least one driven flapper brush rotatably coupled to the cleaning assembly housing. The flapper brush includes an elongated core having an outer surface and end mounting features extending beyond axial ends of the outer surface and defining a central longitudinal axis of rotation. The flapper brush includes a compliant flap extending radially outward from the core to sweep a floor surface as the roller is driven to rotate. The flap is configured to prevent errant filaments from spooling tightly about the core to aid subsequent removal of the filaments. The flapper brush includes axial end guards mounted on the core adjacent the ends of the outer core surface and configured to prevent spooled filaments from traversing axially from the outer core surface onto the mounting features.

Implementations of this aspect of the disclosure may include one or more of the following features. In some implementations, the flapper brush includes multiple floor cleaning bristles extending radially outward from the core, wherein a diameter of the compliant flap about the core is less than a diameter of the bristles about the core. The end guard may be removable from each longitudinal end of the core. In some examples, the end guard is compliant, elastically deforming for removing accumulated errant filaments off of the flaps In another aspect, a coverage robot includes a chassis, a drive system mounted on the chassis and configured to maneuver the robot, and a cleaning assembly carried by the chassis. The cleaning assembly includes a cleaning assembly housing and at least one driven sweeper brush rotatably coupled to the cleaning assembly housing. The sweeper brush includes an elongated core having an outer surface and end mounting features extending beyond axial ends of the outer surface and defining a central longitudinal axis of rotation. The sweeper brush includes multiple floor cleaning bristles extending radially outward from the core. The sweeper brush includes axial end guards mounted on the core adjacent the ends of the outer core surface and configured to prevent spooled filaments from traversing axially from the outer core surface onto the mounting features.

Implementations of this aspect of the disclosure may include one or more of the following features. In some examples, the bristles are disposed about the core in multiple rows, each row forming a substantially V-shaped groove configuration along the core. The end guard may be removable from each longitudinal end of the core. In some examples, the end guard is compliant, elastically deforming for removing accumulated errant filaments off of the bristles. The end guard may be substantially conical.

In yet another aspect, a floor cleaner includes a chassis and a cleaning assembly carried by the chassis. The cleaning assembly includes a cleaning assembly housing, at least one driven cleaning roller rotatably coupled to the cleaning assembly housing, and a sensor system configured to detect spooled material accumulated by the cleaning roller. The sensor system includes an emitter disposed near a first end of the cleaning roller and a detector disposed near an opposite, second end of the cleaning roller and aligned with the emitter. The detector configured to receive a signal emitted by the emitter to detect spooled material accumulated by the cleaning roller.

Implementations of this aspect of the disclosure may include one or more of the following features. The emitter may be an infrared light emitter.

In another aspect, a coverage robot includes a chassis, a drive system mounted on the chassis and configured to maneuver the robot, a controller carried by the chassis, and a cleaning assembly carried by the chassis. The cleaning assembly includes a cleaning assembly housing and at least one driven cleaning roller rotatably coupled to the cleaning assembly housing. The coverage robot includes a roller cleaning tool carried by the chassis and configured to longitudinally traverse the roller to remove accumulated debris from the cleaning roller. The roller cleaning tool includes a body and protrusions extending outward from the body and configured to remove debris from the roller while passing over the cleaning roller.

Implementations of this aspect of the disclosure may include one or more of the following features. The roller cleaning tool may include a linear drive configured to traverse the cleaning tool across the cleaning roller. In some examples, a user manually pushes/pulls the roller cleaning tool along the cleaning roller to remove accumulated debris. In some implementations, the roller cleaning tool is substantially tubular. In other implementations, the roller cleaning tool is semi-tubular or quarter-tubular. The cross-sectional profile of roller cleaning tool may be substantially circular, triangular, rectangular, octagonal, hexagonal, or other suitable shape. In some examples, the roller cleaning tool includes a depth adjustor configured to control a depth of interference of the housing into the cleaning roller.

In another aspect, a robot roller maintenance system includes a coverage robot and a filament stripping tool. The coverage robot includes a chassis, a drive system mounted on the chassis and configured to maneuver the robot, a controller carried by the chassis, and a cleaning assembly carried by the chassis. The cleaning assembly includes a cleaning assembly housing and at least one driven cleaning roller rotatably coupled to the cleaning assembly housing. The filament stripping tool for the roller includes a substantially tubular housing defining first and second openings configured to receive a cleaning roller. The cleaning roller includes a rotatable, elongated core with end mounting features defining a central longitudinal axis of rotation, multiple floor cleaning bristles extending radially outward from the core, and at least one compliant flap extending radially outward from the core and configured to prevent errant filaments from spooling tightly about the core. The roller filament stripping tool includes protrusions extending from an interior surface of the housing toward a central longitudinal axis defined by the housing to a depth that interferes with the compliant flap. The protrusion are configured to remove accumulated filaments spooled about the roller passing through the housing.

Implementations of this aspect of the disclosure may include one or more of the following features. In some examples, at least two of the protrusions extend toward the central longitudinal axis at different heights. At least one of the first and second openings is sized larger than a diameter of the cleaning roller and larger than a diameter of a middle region between the first and second openings. A deforming portion of the housing is sized smaller than a diameter of a cleaning roller to deform peripheral longitudinal edges of the roller as the cleaning roller passes through the housing. In some examples, the deforming portion is sized smaller than a diameter of the bristles and a diameter of the compliant flap about the cleaning roller. The bristles and compliant flap elastically deform to comply with the deforming portion of the housing when the cleaning roller passes through the housing. The filament stripping tool may include a trailing comb disposed on the interior surface of the housing. The trailing comb includes tines configured to remove debris from a cleaning roller passing through the housing. In some implementations, the roller cleaning tool includes a guide ring disposed on the interior surface of the housing. The guide ring is configured to support the housing substantially concentrically on a cleaning roller while permitting rotation of the housing relative to the cleaning roller. The filament stripping tool may include a filament blade disposed on the housing. The filament blade is configured to at filaments and debris away from the cleaning roller. The filament blade may be configured to cut the filaments and debris while the tool traverses over the roller or as a separate cleaning device on the tool. In some implementations, the filament stripping tool includes a fuzz comb extending from the housing in the longitudinal direction and comprising multiple rows of tines. A user may use the fuzz comb to pull fuzz and debris out of the roller bristles.

The details of one or more implementations of the disclosure are set fourth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1A:
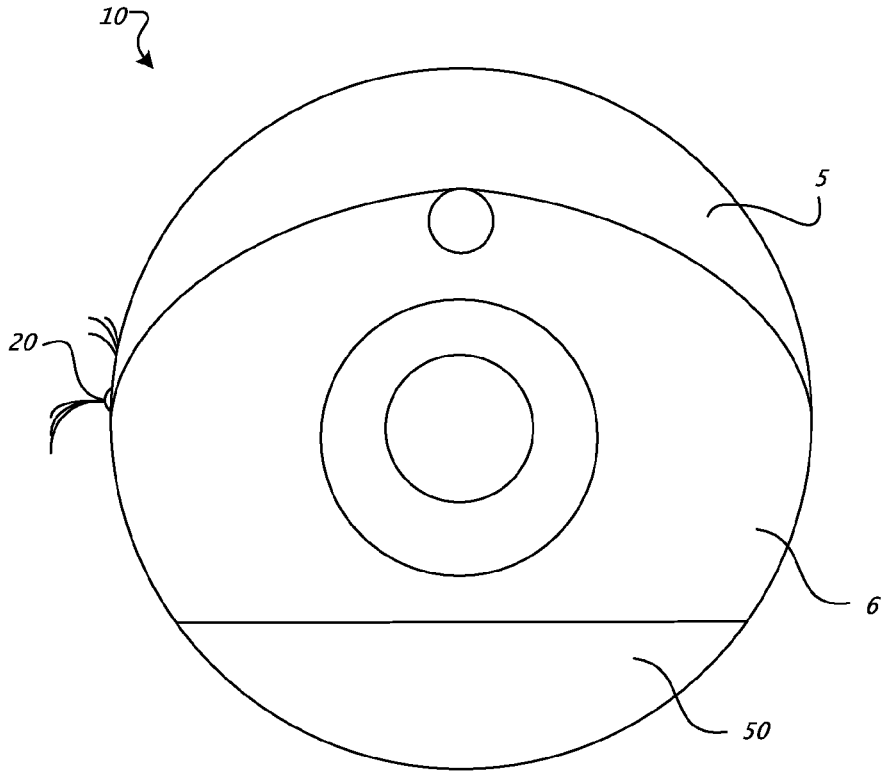
FIG. 1A is a top view of a coverage robot.
Figure 1B:
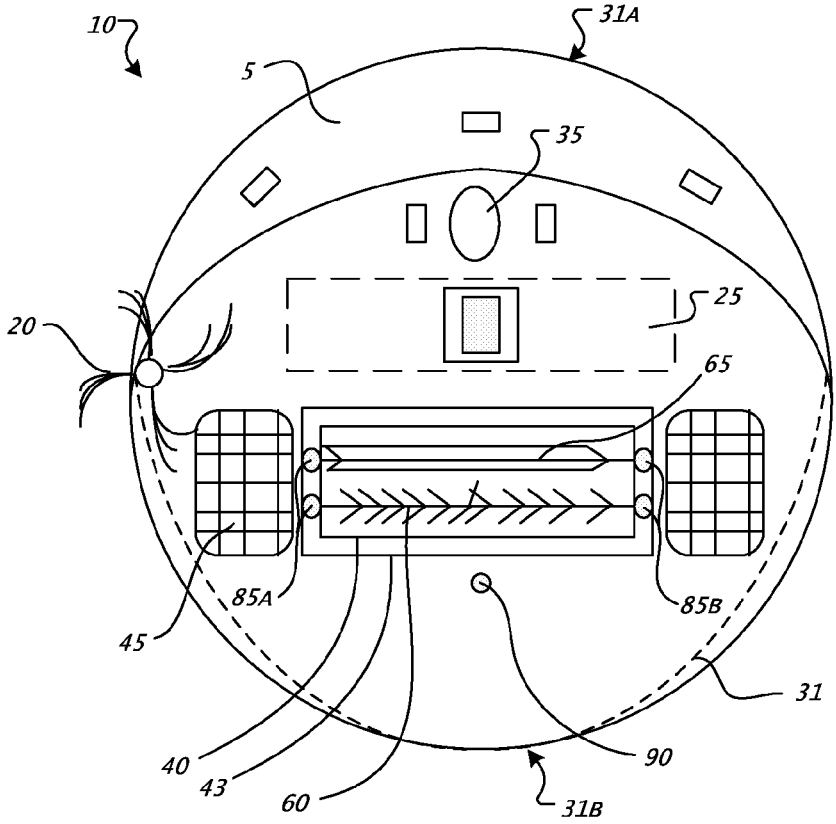
FIG. 1B is a bottom view of a coverage robot.

Referring to FIGS. 1A-1B, an autonomous robotic cleaner 10 includes a chassis 31 which carries an outer shell 6. FIG. 1A illustrates the outer shell 6 of the robot 10 connected to a bumper 5. The robot 10 may move in forward and reverse drive directions; consequently, the chassis 31 has corresponding forward and back ends, 31A and 31B respectively. A cleaning head assembly 40 is located towards the middle of the robot 10 and installed within the chassis 31. The cleaning head assembly 40 includes a main 65 brush and a secondary brush 60. A battery 25 is housed within the chassis 31 proximate the cleaning head assembly 40. In some examples, the main 65 and/or the secondary brush 60 are removable. In other examples, the cleaning head assembly 40 includes a fixed main brush 65 and/or secondary brush 60, where fixed refers to a brush permanently installed on the chassis 31.

Installed along either side of the chassis 31 are differentially driven wheels 45 that mobilize the robot 10 and provide two points of support. The forward end 31A of the chassis 31 includes a caster wheel 35 which provides additional support for the robot 10 as a third point of contact with the floor and does not hinder robot mobility. Installed along the side of the chassis 31 is a side brush 20 configured to rotate 360 degrees when the robot 10 is operational. The rotation of the side brush 20 allows the robot 10 to better clean areas adjacent the robot's side, and areas otherwise unreachable by the centrally located cleaning head assembly 40. A removable cleaning bin 50 is located towards the back end 31B of the robot 10 and installed within the outer shell 6.

Figure 2:
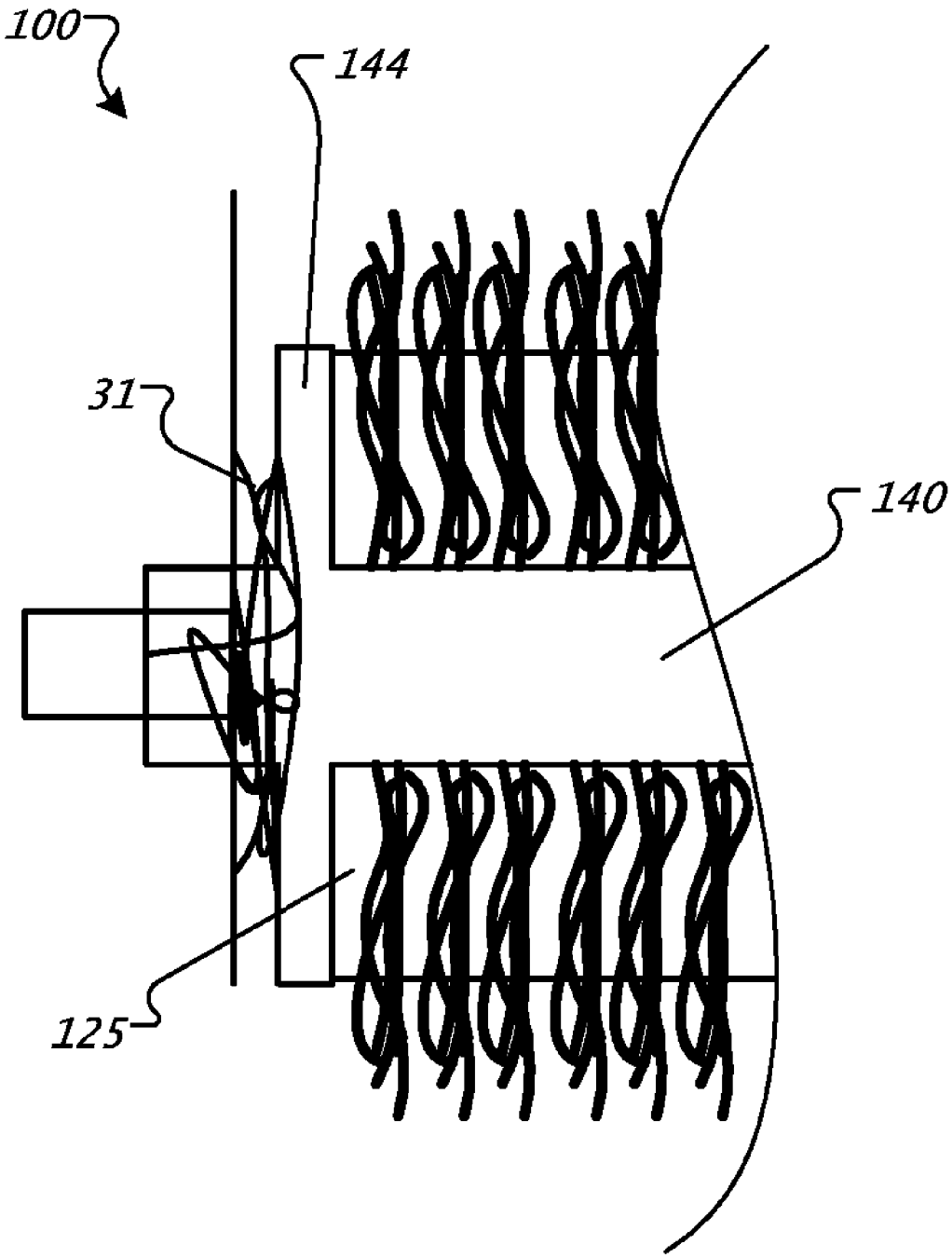
FIG. 2 is a partial side view of a cleaning roller for a coverage robot or cleaning device.
Figure 3:
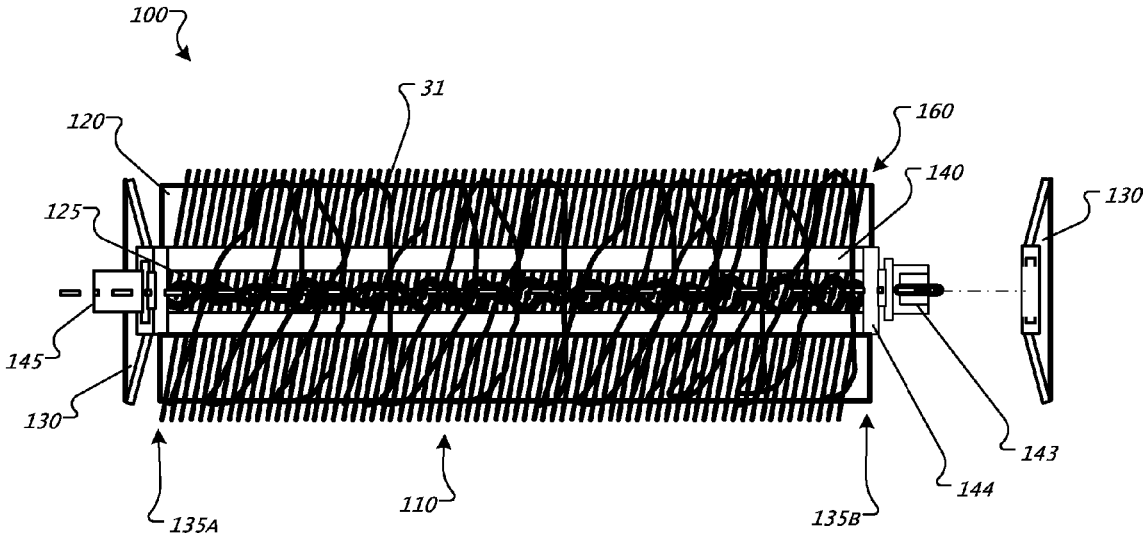
FIG. 3 is a side view of a cleaning roller for a coverage robot or cleaning device.

Referring to FIGS. 2-3, a roller 100 includes an end cap 144, which is a substantially circular plate at either or both ends of the roller 100 supporting integral ribs 125 and/or a brush core 140, and is usually no larger than necessary. Errant filaments or hairs 31 may wind off of the end of the roller 100, past the end caps 144, and enter bushings or bearings 143 rotatably supporting the roller 100 causing decreased cleaning performance or jamming the roller 100. Errant filaments 33 wound about the roller 100 may be difficult and tedious to remove.

Figure 4:
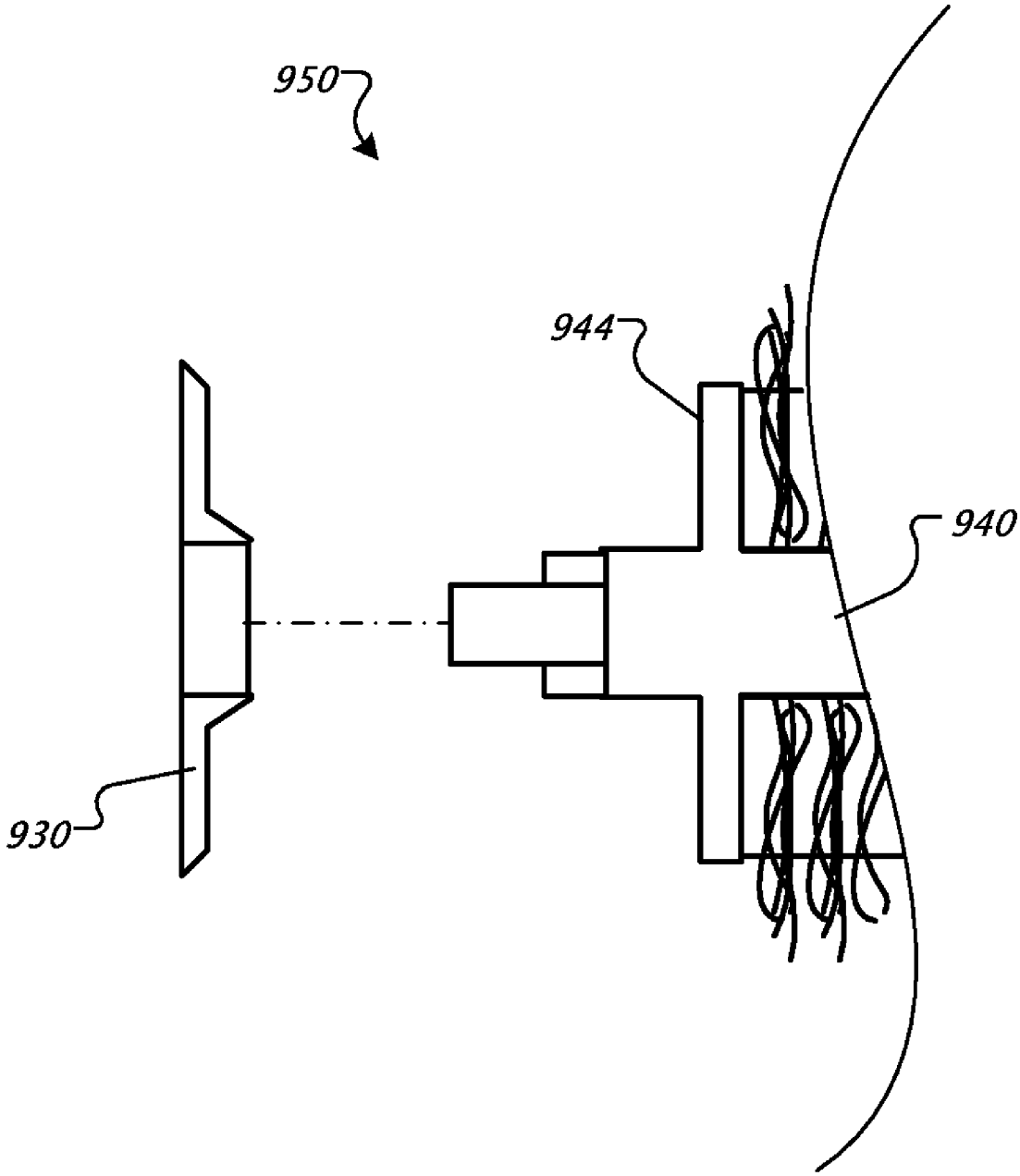
FIGS. 4-6 are partial side views of cleaning rollers for a coverage robot or cleaning device.

FIG. 3 illustrates an example of a spool roller 100. Removable conical end guards 130 made of a soft elastomer limit the longitudinal travel of filaments 33, keep filaments 33 and collected hair 33 within the brush ends 135A-B, and/or prevent hair 33 from spilling over onto bearings 143 that may be located at either one or both longitudinal ends of the roller 100. Elastomeric (e.g. soft) flaps 120 are supported by the core 140 of the roller 100 and extend longitudinally. These elastomeric or inner pliable flaps 120 are arranged between the bristles 110 (on a bristle roller). Although FIG. 4 depicts inner pliable flaps 120 and end guards 130, the end guards 130, as described, are useful for providing an area for hair or other filaments 33 to collect without the use of a pliable spooling surface. The implementation does not necessarily include the inner pliable flaps 120 (or even the bristles 110). If sufficiently pliable, the end guards 130 may be integrated with the brush 160, in which case they are deformed or movable to remove accumulated hair rings.

For example, the roller 100 may be engaged in cleaning a carpeted surface. Although the roller 100 is shown without a vacuum or secondary roller and on a carpeted surface, the roller 100 is useful on hard floors, as part of a roller pair (either similar or dissimilar rollers), and/or with a vacuum (beside, adjacent to, or surrounding the roller). Generally, the construction discussed in detail in Applicant's U.S. Pat. No. 6,883,201, which is hereby incorporated by reference in its entirety, is an effective structure for such rollers.

The end guards 130 prevent the filaments 33 from winding or traversing beyond either extremity of the spool roller 100. In some implementations, the end guards 130 are made of a soft (and/or flexible, and/or compliant) rubber, plastic, polyethylene, polymer or polymer-like material similar to the inner pliable flaps 120. The end guards 130, in some examples, cause filaments 33 to slip back down to the core 140 of the roller 100, if the rotating action of the roller 100 should cause the filaments 33 to approach either end of the spool roller 100. The end guards 130 may be removable, in order to facilitate installation and/or removal of the spool roller 100 from a robot cleaner 10. The end guards 130 need not be conical. In some examples, the end guards 130 have a smaller diameter than the bristles 110.

The core 140 of the roller 100 includes both a twisted coarse wire (e.g. a doable-helix wine core that supports the bristles 110) and a set of integral ribs 125 (integral with end caps 144 and roller axle 145). The core 140 includes a driven part (keyed or geared end) and a supporting part. In this implementation, the end guard 130 is formed as a full or partial truncated cone, the small diameter portion of the truncated cone having a through hole formed therein for receiving the roller axle 145, and being mounted toward the roller axle 145, and the large diameter portion of the truncated cone being mounted away from the roller axle 145. The end guard 130 is removable for brush cleaning and it keeps any hair 33 trapped within the two ends, thus keeping the drive mechanism clean (free of hair).

Referring to FIGS. 4-8, in some implementations, a spool roller 950 includes end guards 930. Although this implementation does not necessarily include a soft flap 120 (or even bristles 110), the end guards 930 prevent filaments 33 from winding or traversing beyond either extremity of the spool roller 950. The end guards 930 may be made of a substantially rigid plastic or other material used for consumer appliances, or soft material similar to the inner pliable flaps 120. The end guards 930, by preventing the hair or other filaments from winding past the end caps 944, cause filaments 33 which travel past the end caps 944 to slip down to the core 940 of the spool roller 950, if the rotating action of the spool roller 950 should cause the filaments 33 to approach either end of the spool roller 950. Ringed clumps of filaments 33 or hairs become trapped between the end caps 944 and the end guards 930.

Figure 5:
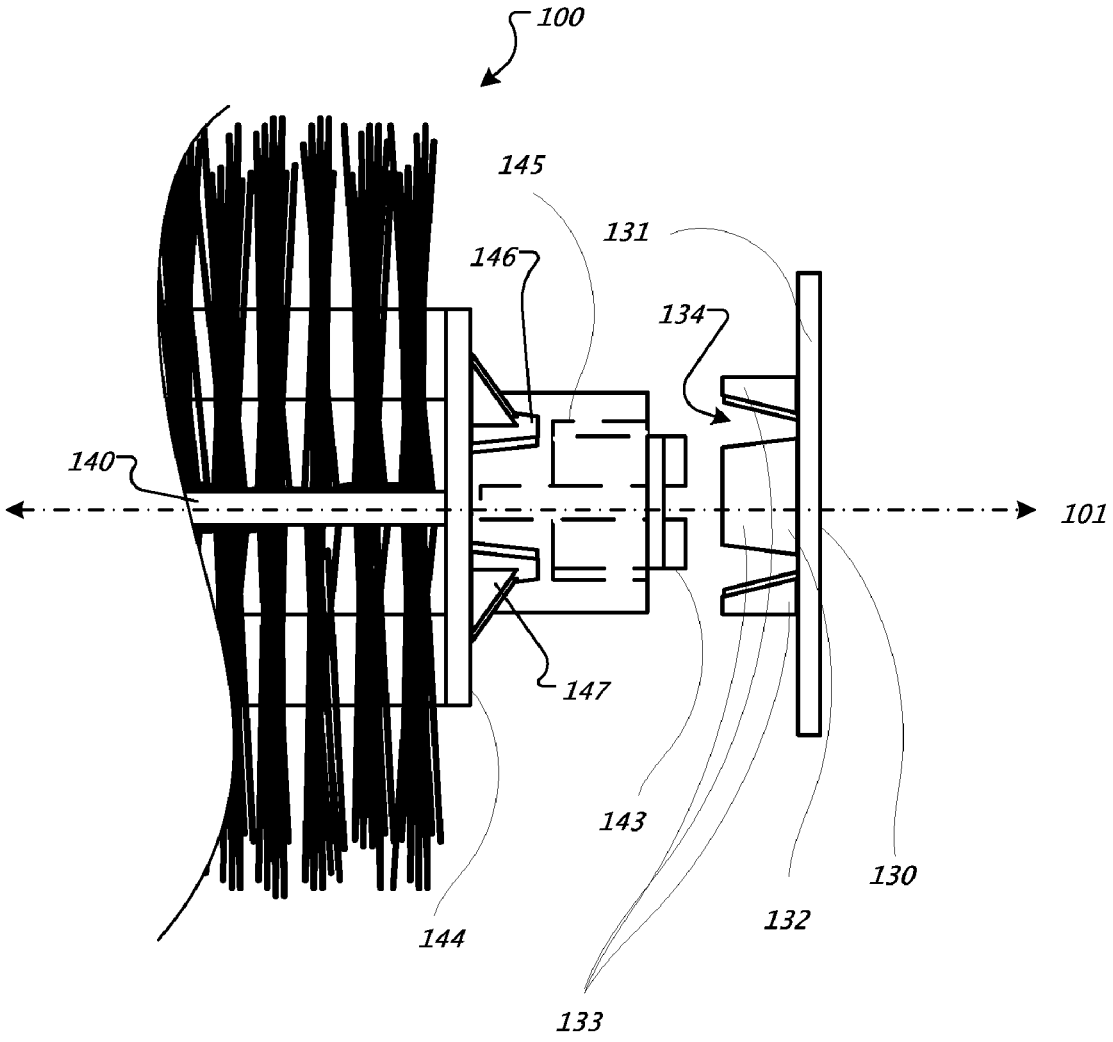
Figure 6:
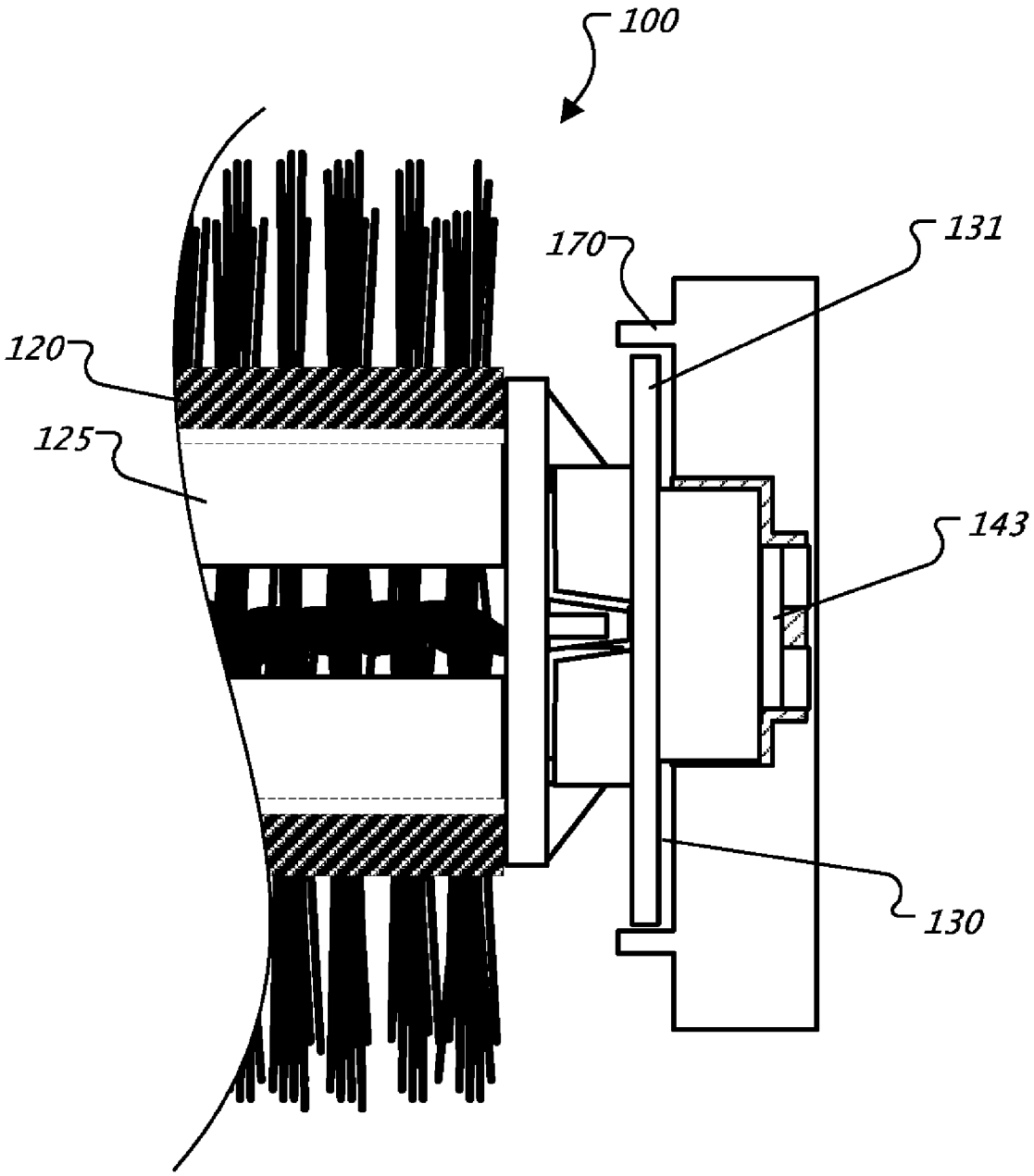

FIGS. 5 and 6 provide additional details of the spool roller 100. As shown in FIG. 4, the end guard 130, in some examples, is removable, in order to facilitate installation and/or removal of the spool roller 100 from a robot 10 or other primary cleaning device. In particular, the end guard 130 may take the form of a flat torus 131 and a mounting ring 132. The mounting ring 132 may be made of plastic, with sector tabs 133 (e.g. curved trapezoids or crenellations formed therein) and defined notches 134, and a slightly tapering inner diameter that tapers down from a slip fit (with the roller axle 145 of the roller core 140) at the flat torus 131 to a tight slip fit or very slight interference fit at the ends of the tabs 133. The ends of the tabs 133 are deformed as the end guard 130 is mounted to the axle 145, and maintain a relatively tight fit during use, yet are easily removed. As shown in FIG. 5, the notches 134 defined between the sector tabs 133 may mate with corresponding angles or protrusions 146 on the axle 145, preventing the end guard 130 from rotating.

FIG. 5 shows the end of the roller 100 (turned so the ribs 125 are orthogonal to a viewer) with the end guard 130 about to be mounted. The end guard 130 is slid onto the axle 145 of the roller 100 until the tabs 130 abut the end cap 144, or until the protrusions 146 on the axle 145 and/or end cap 144 abut the flat torus of the end guard 130. The bearing 143 is a plastic-housed metal bushing that is mounted on a metal axle pin within the axle 145 of the roller 140, and the bushing 143 is mounted to a compatible holder on the robot 10, such that the roller 100 rotates on the metal axle pin about the bushing 143. For example, the axle 145 and the end guard 130 can be mounted in a robot 10 to rotate about the bearing 143, which mates with the mount in the robot 10. Triangular shaped features 147 on the roller 100 act as ramps, allowing the end guards 130 to be easily twisted off the roller 100 for servicing.

Referring to FIG. 6, in some examples, a "fender" or labyrinth wall 170 provided in the cleaning head or robot is a perimeter wall about the outer periphery of the flat torus 131 of the end guard 130. The labyrinth wall 170 forms a simple labyrinth seal that further prevents accumulations of hair and other filaments 33 from passing the end guard 130 to enter the area where the bearing/bushing 143 is mounted.

The end guard 130 is compatible with and enhanced by the inner pliable flaps 120. For example, the diameter of the end guard 130 and the end caps 144 need not be the same, and if the end guards 130 are removed from a roller 100 having the inner pliable flaps 120, accumulations of pet hair can be readily removed, and the inner pliable flaps 120 are exposed in the axial direction for easy cleaning with (or without) secondary cleaning tools.

Figure 7A:
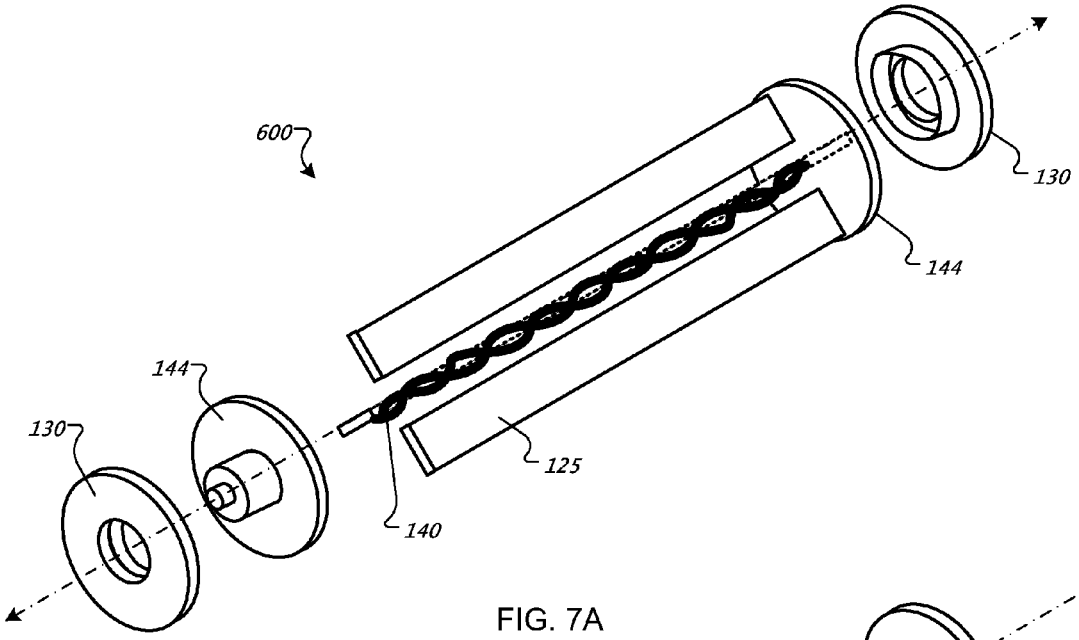
FIGS. 7A-7B are exploded views of cleaning rollers for a coverage robot or cleaning device.
Figure 7B:
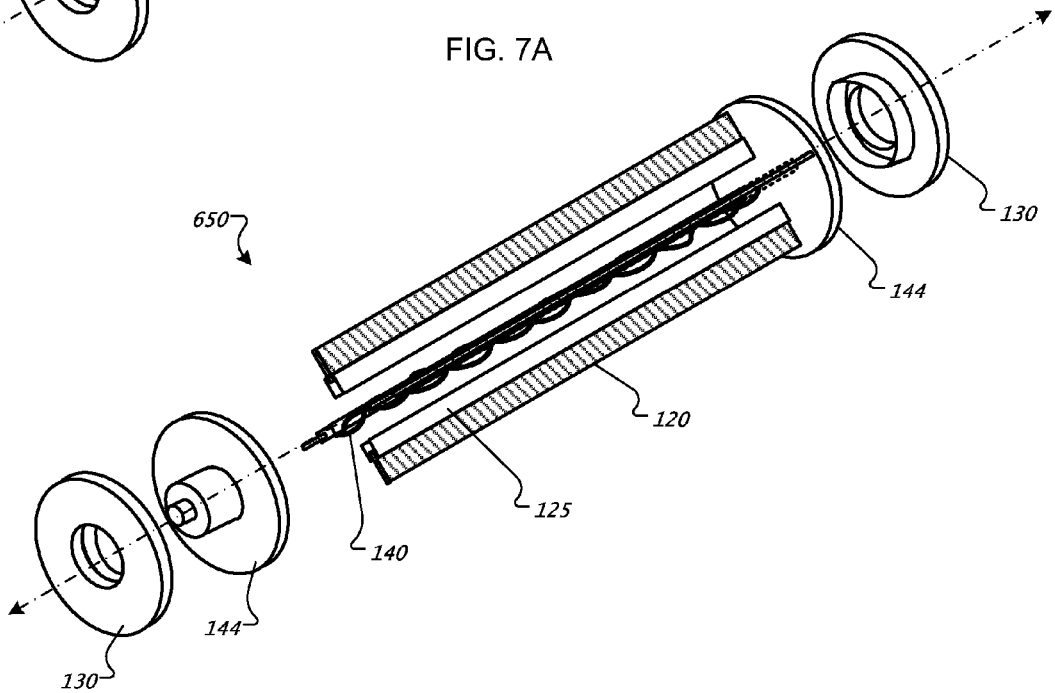
Figure 8:
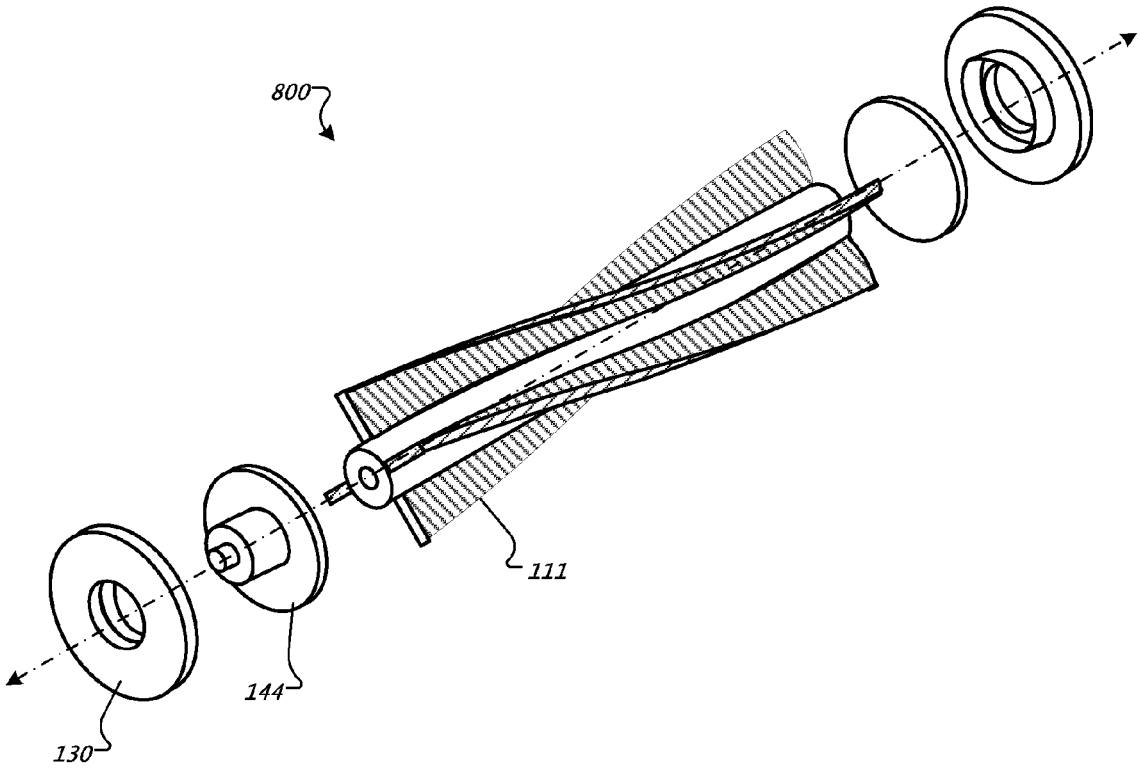
FIGS. 8-9 are exploded views of cleaning rollers for a coverage robot or cleaning device.

FIGS. 7A-7B and 8 show different configurations which may make use of the end guards 130. In FIGS. 7A and 7B, for the purposes of illustration, only the brush core 140, and not bristles 110 or beaters 111 are shown. Nonetheless, each configuration may include bristles 110 and/or beaters 111 between the integral ribs 125. FIG. 7A depicts a roller 600 having end caps 144 and integral ribs 125, but no inner pliable flaps 120. The end guard 130 permits the user to readily remove accumulated filament 31 or hair ring clumps from the roller 600. FIG. 7B depicts a roller 650 having end caps 144, integral ribs 125, and inner pliable flaps 120. Again, the end guard 130 permits the user to readily remove accumulated filament 31 or hair ring clumps from the rollers 650, works with the inner pliable flaps 120 to provide two different cleaning enhancements, and permits ready access to the inner pliable flaps 120 (especially for those implementations in which the end guard 130 is made of a larger—e.g., by about 0.5 to 8 mm—diameter disc or ring than the end cap 144).

FIG. 8 shows a beater-only roller 800 (optionally with bristles replacing any one or more of the beaters 111) having end caps 144, spiraling/winding/helicoid beaters 111 (which may be flexible but hard rubber) but no inner pliable flaps 120. The beaters 111 may be compliant and deformable.

In any of these implementations, when a user removes the end guard 130 or 930 from the end of the spool roller 100, 600, 650, 800, 950, the ring-like clump of filaments 33 can easily be slipped off from the end of the spool roller 100 by simply pulling the filaments 33 off past the end. Alternatively or in addition, the mounting ring 132 of the end guard 130 may have an outer peripheral profile that conically slopes downward and inward (i.e., toward the center of the roller 100 away from the end of the roller 100), in order to urge any accumulating filaments 33 away from the end of the roller 100 as the roller 100 spins.

The end guard 130 may have an inner edge for closely abutting the outer edge of the end cap 144, such that the outer surface (e.g. axle) of the roller 100 is blocked and protected by the end guard 130. When the end guard 130 is detached from the roller 100, any accumulated filaments 33 can easily be removed if the smallest possible diameter for rings of accumulated filaments 33 is limited to the diameter of the mounting ring 132 of the end guard 130 abutting the end cap 144 (and thus not the diameter of the roller 100), which may prevent tight winding of the accumulating filaments 33 about the roller 100 and also prevent filaments 33 from reaching the bearings 143.

Figure 9:
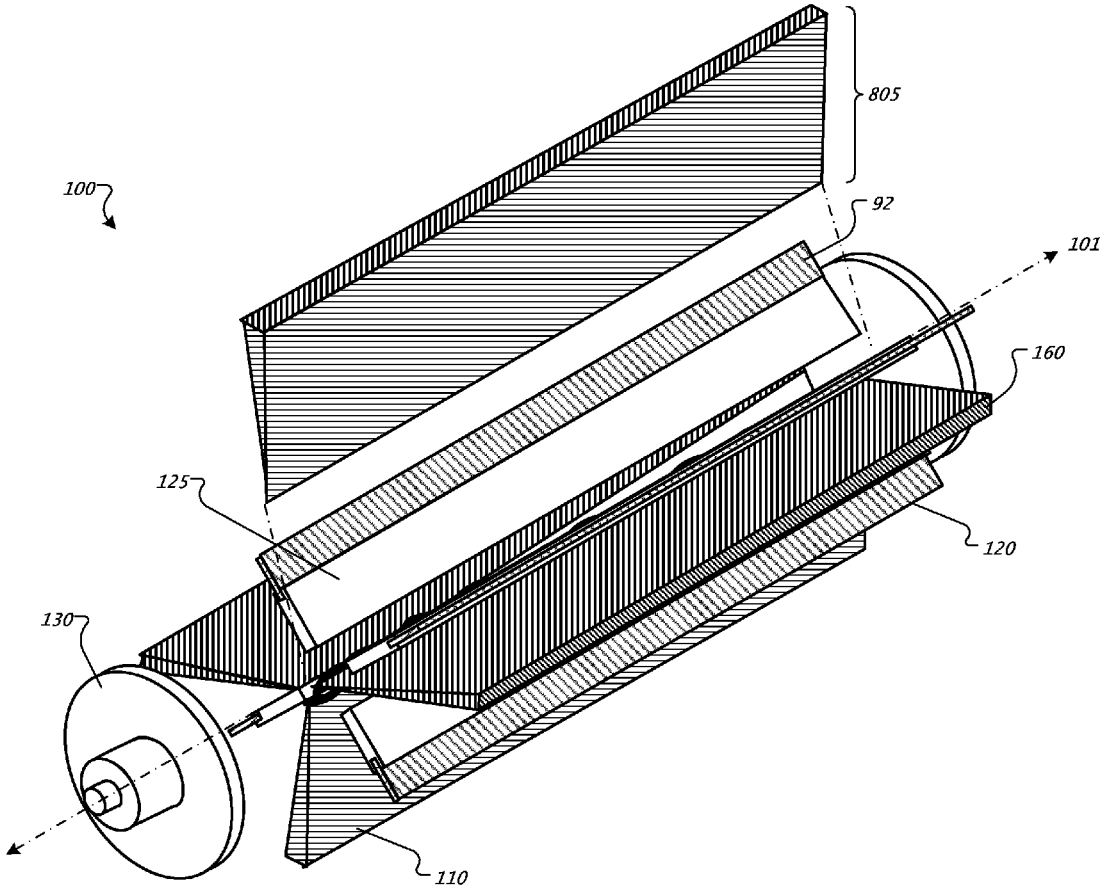
Figure 10:
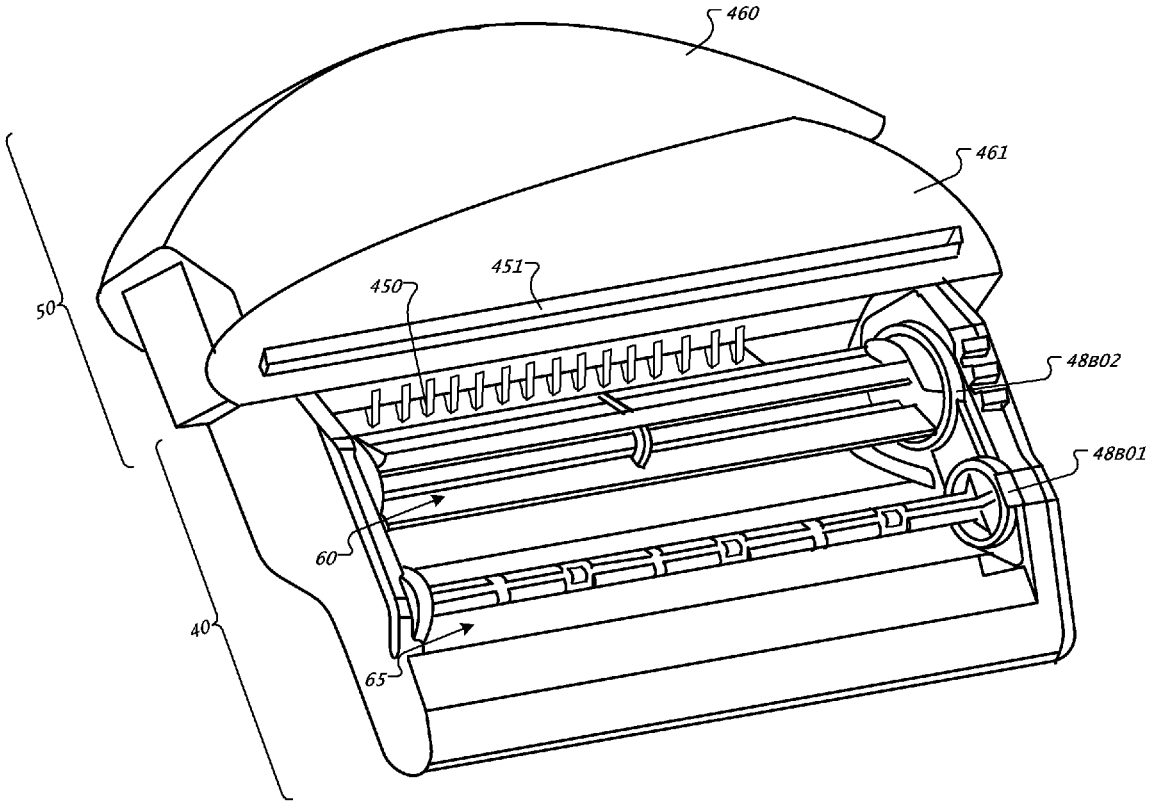
FIG. 10 is a perspective view of a cleaning head for a coverage robot adjacent a cleaning bin.

Referring to FIG. 9, in another implementation, the robot 10 may include a brush roller 100 for cleaning smooth and/or fibrous flooring surfaces (such as linoleum or tufted carpet, respectively, for example). The brush roller 100 includes a twisted helix wire bundle (central core member 140) forming a base for many bristles and a set of integral ribs 125 distributed along radial directions about the axis 101 of the roller 100. Applicant's U.S. Pat. No. 6,883,201, hereby incorporated by reference in its entirety, provides additional brush disclosure. Integral ribs 125 may impede the ingestion of matter such as rug tassels and tufted fabric by the main brush, and filament 31 and other hair-like debris can become wound about the ribs 125. A flapper brush 92 can be provided with axle guards 130 having a beveled configuration for the purpose of forcing hair and other similar matter away from the flapper brush 92 to prevent the matter from becoming entangled with the ends of the flapper brush 92. As shown in FIG. 6 of the '201 document (FIG. 10), a rim can extend completely about a first output port and second output port 48B02, 48B01 of a dual output port gear box. The soft flaps have a beneficial elastic action during anti-tassel rotation (reversing rotation to reject carpet tassels), releasing tassels to some extent.

The soft flaps 120 on the roller 100 act as a cushioning spool when long fringes/tassels get wrapped around the brushes 160. The soft flaps 120 cushion the tug on the tassels and permit easier release of the tassels since the elastic deformation on the flaps 120 acts as a spring-back mechanism to release the tassels from a tight wind on the hard roller core 140. When the robot 10 uses anti-tassel software, the robot 10 frees-up easier (as lesser force is required to unwind the already sprung-up tassels) when cleaning with such a flap-fitted brush roller 100.

In some implementations, bristles 110 of may extend radially outward from the core 140 (not shown in FIG. 9). The bristles 110 may be arranged in straight, angled, or curved rows; in clusters similarly arranged; or essentially randomly. For illustration purposes, FIG. 9 does not show individual bristles, but shows a rough bristle envelope 805 (a volume occupied by a typical bristle row) as a simplified triangular prism shape. In addition to the bristles 110, the roller 100 includes inner pliable flaps 120, which may extend along the roller 100 generally parallel to the bristles 110. The inner pliable flaps 120 may be self-supporting (i.e., largely attached directly to some part of the brush core, such as a hollow core) or may be formed as part of and/or supported by integral ribs 125 (especially in the case where a wound spiral wire core is used). If the bristles 110 tend to spiral or follow another path, the inner pliable flaps 120 may be arranged to follow such paths or cross such paths.

In most cases, the roller 100 will rotate in a direction opposite to the direction of movement of the robot 10 (e.g., optionally facing a secondary, counter-rotating roller). However, in some cases, the roller 100 will rotate in a direction that is the same as the direction of movement during normal cleaning. In some implementations, as the roller 100 spins about its longitudinal central axis, the rows of bristles 110 impinge on the tufted fibers of carpet and contact dirt, filaments, debris on the piles of the carpet. In other implementations, the inner pliable flaps 120 are positioned to bend from contact with the cleaning surface, positioned to not contact the cleaning surface, and positioned so that only some inner pliable flaps 120 contact the cleaning surface.

The narrow, stiff fibers of the bristles 110 may beat or skim the carpet pile or other surface, or sink into and emerge from the carpet pile by virtue of the spinning of the roller 100. Debris driven by or caught by the bristles 110 may be carried off of or out of the carpet pile or other surface. The debris or filaments may be swept directly into the bin 50, or toward a vacuum, secondary roller 65, or other secondary transport device may serve to entrain, catch, or capture debris and/or filaments ejected from the direction of the roller 100, either in combination with or independently of the roller 100.

As the roller 100 is applied to a cleaning surface, strands of hair, thread, or other long fibers (also referred to as the filaments 33) lying on the surface may be picked up by the rotating bristles 110 or inner pliable flaps 120 and become wound around the roller 100. In addition to a direct sweeping action, the bristles 110 also may condition tight tufts of carpet fiber, drawing debris out from the carpet which can then adhere to "sticky" material of the inner pliable flaps 120. As the bristles 110 clean the work-surface, the bristles 120 trap and pick up hair among other debris, such as the filaments 33, for example.

The inner pliable flaps 120 generally extend in a paddle-wheel arrangement generally along the length of the roller, but may also extend in a spiraling or helical arrangement similar to the reel blades of a mower reel. The diameter of the inner pliable flaps 120 may be slightly shorter than the diameter of the bristles 110 themselves, and the inner pliable flaps 120 may work in conjunction with the bristles 110. In order to place the spooling diameter appropriately and facilitate cleaning with a tool, the inner pliable flaps 120 may have a diameter measurement that is less than the diameter of the bristles 110. The inner pliable flaps 120, in the case where they are supported by integral ribs 125, extend radially from about 1-20 mm less (in the radial direction) than the radius of end caps 144 to about 1-10 mm greater (in the radial direction) than the radius of end caps 144 (for a 30-60 mm diameter roller 100; larger rollers would have flaps 120 of proportional size).

The filaments 33 are permitted to sink slightly into the bristles 110 or between the bristles 110 while winding about the outer perimeter of the inner pliable flaps 120, but not to traverse to the base of the bristles 110 at the core 140 of the roller 100. The material and/or thickness or shape of the inner pliable flaps 120 may be selected so as to support spooling of filaments 33 on the outer edges thereof, while still maintaining elastic flexibility. Creases or "dead zones" in the cleaning bristles 110 of the roller 100 may be prevented. Instead of parting or crushing the fibers of the bristles 110 at the base of the bristles 110, the rings of filaments 33 accumulate on the inner pliable flaps 120 which are below the outer edges of the bristles 110.

The presence of inner pliable flaps 120 between bristles 110 provide a spooling frame that spools the hair or other filaments 33 and prevents hair or other filaments 33 from being wound tightly along a roller body 140. In the case of a spooling frame including integral ribs 125 and inner pliable flaps 120 (e.g. in a paddle-wheel arrangement), the inner pliable flaps 120 provide a stand-off. The hair or other filaments 33 will not tightly wind about the integral ribs 125. Where a roller body 140 is used, the inner pliable flaps 120 may add strength to the bristles 110 by acting as a backbone and by keeping bristles coordinated and/or aligned properly.

The inner pliable flaps 120 collect debris that may have evaded or slipped past the bristles 110 as the bristles 110 dig into medium to high pile carpets. The bristles 110 may agitate the carpet fibers for better cleaning and the flaps 120 may beat the debris into the cleaning/picked-up-dirt-travel path. On medium to high-pile carpets, dirt picked up or dirt picked-up per unit of power consumption increases by as much to ⅓ in comparison to bristles only. This brush, and the other brushes described herein, may be employed in manual vacuum cleaners and also sweepers, including upright, canister, and central vacuum cleaners.

Referring to FIGS. 11A-15C, a roller cleaning tool 200 may be used to remove spooled filaments or hair 33 from the roller 100. The roller cleaning tool 200 includes a substantially rigid (e.g., molded plastic) tube 240 and one or more protrusions 250 (referred to as "teeth") positioned radially around the tubular tool 200 and extending from the interior surface 243 of the tube 240 toward a central longitudinal axis 201 of the tube 240. The tube 240 includes two oppositely placed openings 241, 242 (one on each longitudinal extremity of the shaft 240) through which the roller 100 may be passed (or vice versa). In cases where one opening 241, 242 is wider than the other, the two openings 241, 242 can be described as an entry openings 241 and an exit opening 242. In cases where both openings 241, 242 are of similar diameter, or the tube 240 is designed to be passed in both directions, both openings function as entry and exit openings, 241 and 242 respectively.

Figure 11A:
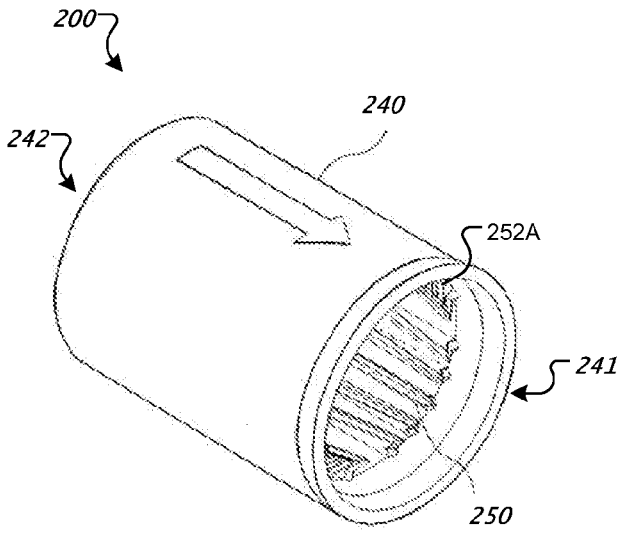
FIG. 11A is a perspective view of a roller cleaning tool.
Figure 11B:
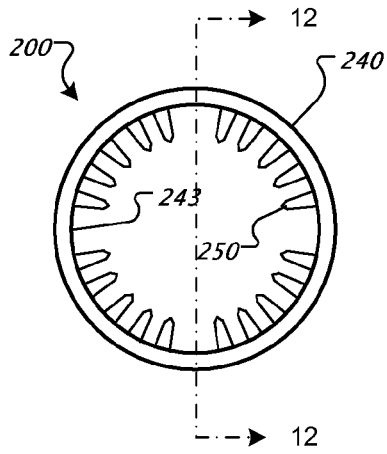
FIG. 11B is a front view of a roller cleaning tool.

As shown in FIGS. 11A-11B, one example of the roller cleaning tool 200 includes forward canted teeth 252A that are arranged within the main diameter of the roller cleaning tool 200, angled toward a wider entry opening. In one implementation, four clustered groups of five teeth 250 may be separated from one another by 2-8 mm and from the next cluster by 4-12 mm in a 2-5 cm tube. In some examples, the separations between teeth clusters are present in the same number as the number of integral ribs 125 or inner pliable flaps 120. The teeth 250 may include an angled entry portion or hook, e.g., a V-shaped profile on the leading edge of each tooth, opening toward the roller in the direction of tube application.

In some examples, the teeth 250 can be installed or formed in the tubular tool 200 such that the teeth 250 protrude from the inner surface 243 at a substantially orthogonal orientation to the inner surface 243. In an alternative implementation, the teeth 250 may be canted or angled toward the opening of the tubular tool 200, for example, and/or may include a hook, angle, loop, or other appropriately shaped member for seizing and retaining debris, as shown in other drawings. The teeth 250 would usually be formed in one piece with the tube by molding, especially if the tube 240 and teeth 250 are plastic; but may be formed separately from the tube 240, and then attached thereto (e.g., by forming plastic to surround or affix metal teeth within a plastic tube). Some or all of the teeth 250 may also have a leading blade to cut hairs or filaments.

In some examples, the roller cleaning tool 200 defines a "bell-mouthed" or "musket-shaped" profile having a diameter that is wider at the (mouth) opening 241. A diameter D1 of the opening 241 of the bell-mouthed tubular tool 200 may also be greater than the diameter of the bristles 110 and/or inner pliable flaps 120 of the roller 100. The opening diameter D1 permits the user to more easily guide the roller 100 into the opening 241 of the bell-mouthed tubular tool 200 due to the compaction of the bristles 110 and/or inner pliable flaps 120 of the roller 100. The opening 241 may have a diameter D1 that tapers from its widest section at the opening 241 down to a substantially constant but narrower inner diameter D2 (e.g. FIG. 13).

Figure 12:
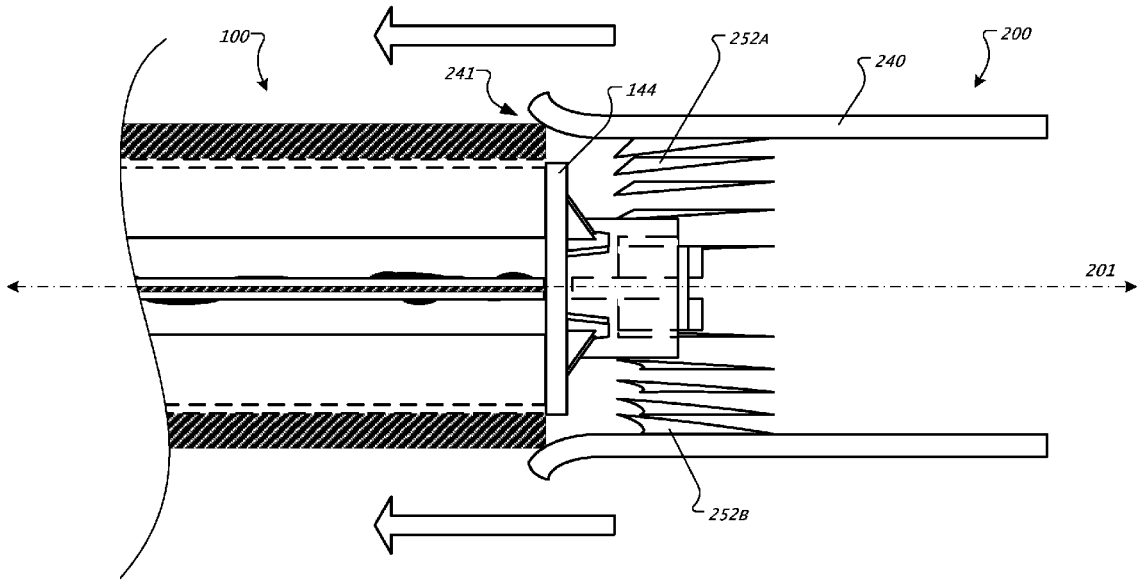
FIG. 12 is a sectional side view of a roller cleaning tool cleaning a roller.

FIG. 12 demonstrates the roller cleaning tool 200 in use. As shown, the roller cleaning tool 200 is applied with the larger opening 241 toward the roller 100, which facilitates entry of the roller 100 into the tool 200. The diameter D1 of the larger opening 241 is at least slightly larger than the axial extension or spooling diameter of the inner pliable flaps 120. Along the length of the tube 240, the tube 200 narrows to a constant, main diameter, and the inner pliable flaps 120 are deformed by the main inner diameter D2 of the tube 200. Any filaments or hairs 31 collected about the spooling diameter are positioned where they will be caught by the approaching teeth 250 (which extend into the tube 200 to a point that is closer to the roller axis 101 than the undeformed flaps 120, but farther away than the end cap 144). Two kinds of teeth 250 are shown in FIG. 12, triangular forward canted teeth 252A with a straight leading profile, and shark-tooth forward canted teeth 252B with a curved entry portion or hook, e.g., a U or J-shaped profile on the leading edge of each tooth, opening toward the roller 100 in the direction of tube application. Either or both teeth 252A, 252B may be used, in groups or otherwise.

In some implementations, the inner pliable flaps 120 of the roller 100 are soft or pliable and can flex, which allows for a manual roller cleaning tool 200 with teeth 250 to be slid length-wise, optionally with a slight twisting action, over the combination flap-bristle roller 100. The roller cleaning tool 200 compresses the inner pliable flaps 120 allowing wound-up rings of hair or filament 31 to loosen and slide off the roller 100 easily, as teeth 250 in the tool 200 grab the windings and clumps of hair or other filaments 33.

Preferably, the diameter D2 of a portion of the tube 240 (and/or the entry 241 and/or exit opening 242 of the tube 240) is less than the undeformed diameter of the bristles 110 or beaters 111, and when inner pliable flaps 120 are provided, less than the inner pliable flaps 120 of the roller 100. As the roller 100 passes through the roller cleaning tool 200, the bristles 110 and/or inner pliable flaps 120 of the roller 100 deform inward such that the tension of any filaments 33 spooled around the bristles 110 and/or inner pliable flaps 120 is relieved by the deformation. Teeth 250 placed to work within any spooling diameter catch the filaments without necessarily relying upon the deforming the bristles or inner pliable flaps 120. Deforming bristles 110 to bend away from the direction of tube movement facilitates movement of clumps and filaments 33 off the end of the bristles 110 as the ends of the bristles 110 are curved to point in the direction of the tube movement. Deforming the inner pliable flaps 120 (or any beaters) to bend toward the axial center of the tube 240 facilitates movement of clumps and filaments 33 along the deformed inner pliable flaps 120 in the direction of the tube movement.

Figure 13:
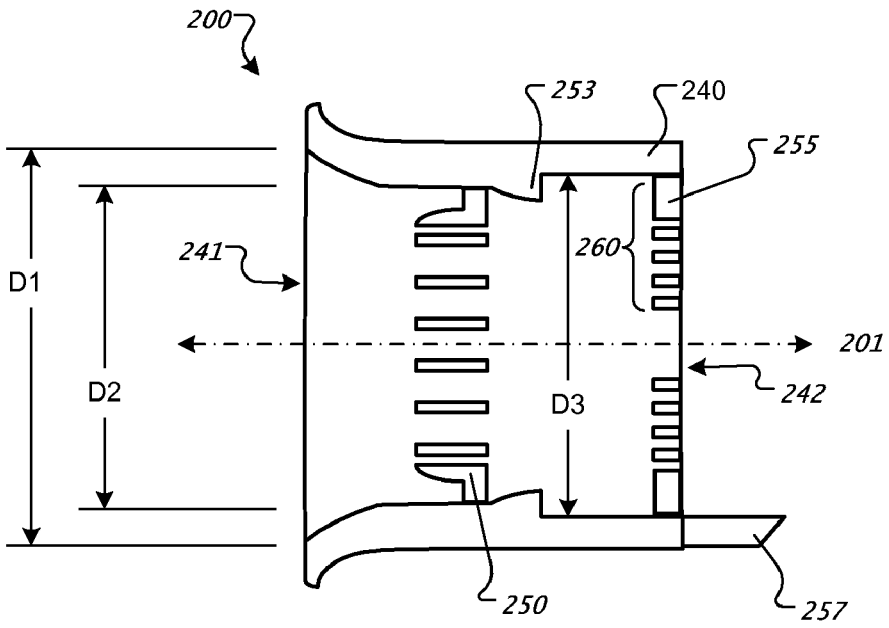
FIG. 13 is a sectional side view of a roller cleaning tool.

Referring to FIG. 13, in some implementations, the roller cleaning tool 200 includes trailing comb teeth 255, which may grab and trap remaining loose strands of filaments 33 or debris. The trailing comb teeth 255 form the internal tines of at least one comb 270 protruding from the internal surface 243 of the tube 240. If filaments or hairs 31 from a roller 100 are missed or released by the teeth 250, one or more tines 255 of one or more combs 260 provide an additional debris-seizing mechanism. The combs 260, having a smaller size and spacing, also tend to slide along the forward-bent bristles 110, entraining hair and filaments that are not necessarily hooked by the teeth 250. The tines 255 may be formed to be more deformable, deeper, thinner, or harder (and vice versa) than the teeth 250. The tines 255 may elastically bend, and/or scrape or sweep the exterior surfaces of the core 140 of the roller 100 and/or the bristles 110. In the example shown, the trailing comb teeth 255 are disposed in a trailing region of the tube 240 having a diameter D3 larger than the diameter D2 of a fore-region of the tube 240.

In some examples, the tool 200 includes one or more protrusions 253 extending from the interior surface 243 toward the center axis 201 of the tube 240 and located rearward of the teeth 250. The protrusion 253 may be defined as a continuous ring extending inward from the interior surface 243 of the tube 243. The protrusion 253 aids filament 31 removal.

In some examples, the tool 200 includes a cutter 257 for cutting filament or other objects off the roller. In the example shown, the cutter 257 extends longitudinally off the exit end 242 of the tool 200. In other examples, the cutter 257 may extend laterally or at any angle off the entry end 241, exit end 242, or anywhere therebetween.

Each tooth 250, in some examples, is about 1-2 mm wide and spaced from a neighboring tooth 250 in the same group by about the same amount, the trailing comb teeth 255 are less than about 1 mm wide and spaced equal to or less than their width. One exemplary distribution has six groups of two to five teeth 250, and six groups of seven to fifteen trailing teeth 255 (the number of groups may correspond to the number of bristles 110; integral ribs 125; or inner pliable flaps 120). In some instances, the teeth 250 are configured as forward-pointing hooks or finger teeth rather than a comb tooth.

In some implementations, the teeth 250 may be arranged in two or more positions longitudinally along the length of the tubular tool 200. For example, the teeth 250 at the second position may be comb teeth rather than hook teeth, e.g., first (hook) teeth 250 extend inward toward the center of the tubular tool 200 near a first opening of the tubular tool 200, and second (comb) teeth 250B, extend inward by less than the teeth 250 at a second position farther away from the opening. Insertion effort required to initially insert the roller 100 into the tubular tool 200 may be designed by altering the diameter, bell mouth, and positioning of the teeth 250 at particular distance from the opening of the tubular tool 200. Alternatively, the teeth 250 and 255 may be positioned at the same longitudinal position along the tubular tool 200, at different positions and depths about the circumference, individually or in clusters, so that thicker or thinner accumulations of filaments and/or having varying degrees of tufting or fraying are more likely to be engaged by at least one of the clusters of teeth 250 or 255.

Figure 14:
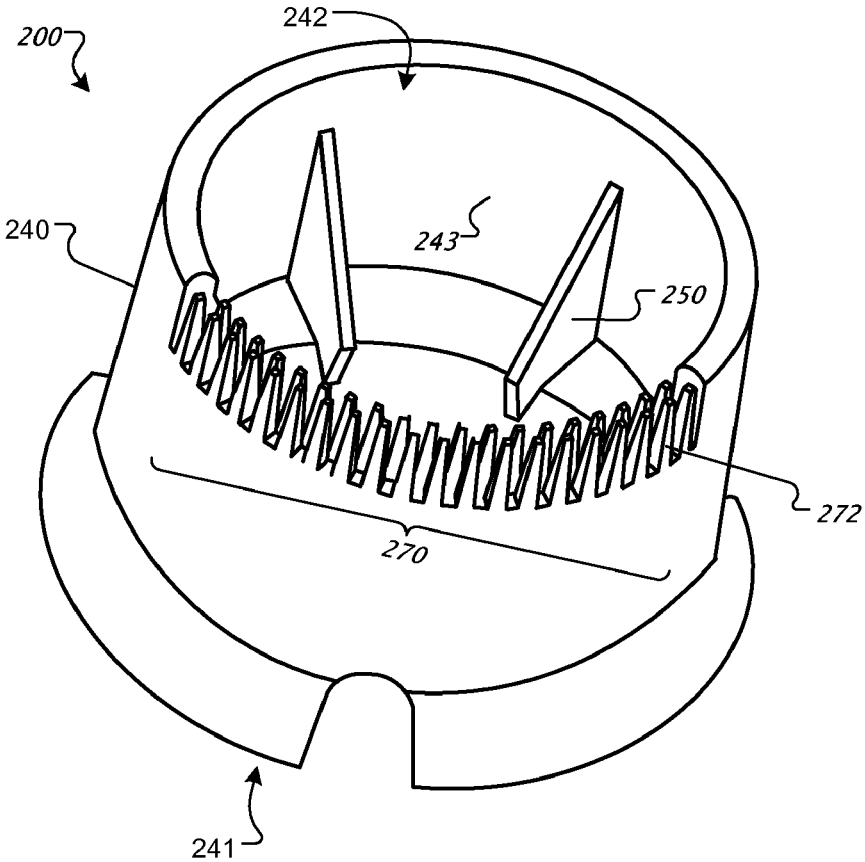
FIG. 14 is a perspective view of a roller cleaning tool.

Referring to FIG. 14, in some implementations, the tool 200 includes a fuzz comb 270 extending in the longitudinal direction. The multi-tine comb 270 is arranged along a sector of the exit end 202 of the tube 200. Staggered multiple rows of teeth 272 in the fuzz comb 270 grab fine fuzz and wooly pet hair off the brush bristles 110. Staggered multiple rows of teeth 272 provide superior combing over a standard single-row comb. In some examples, the comb 270 includes parallel arranged teeth 272 that taper at a distal end and configured as flat cantilevered beams off the exit end 242 of the tool 200. In other examples, the comb 270 does not extend beyond the exit end 242 of the tool 200 (as shown). After passing the cleaning tool 200 over the roller 100 one or more times to remove debris or filament, the comb 270 may be used to clean remaining hair or filaments not previously removed. As such, the tool 200 combines the features of a stripping ring tube and a flat brush, and the user need not pick up two tools or put down the roller 100 in order to finish detailed cleaning of the roller 100.

Figure 15:
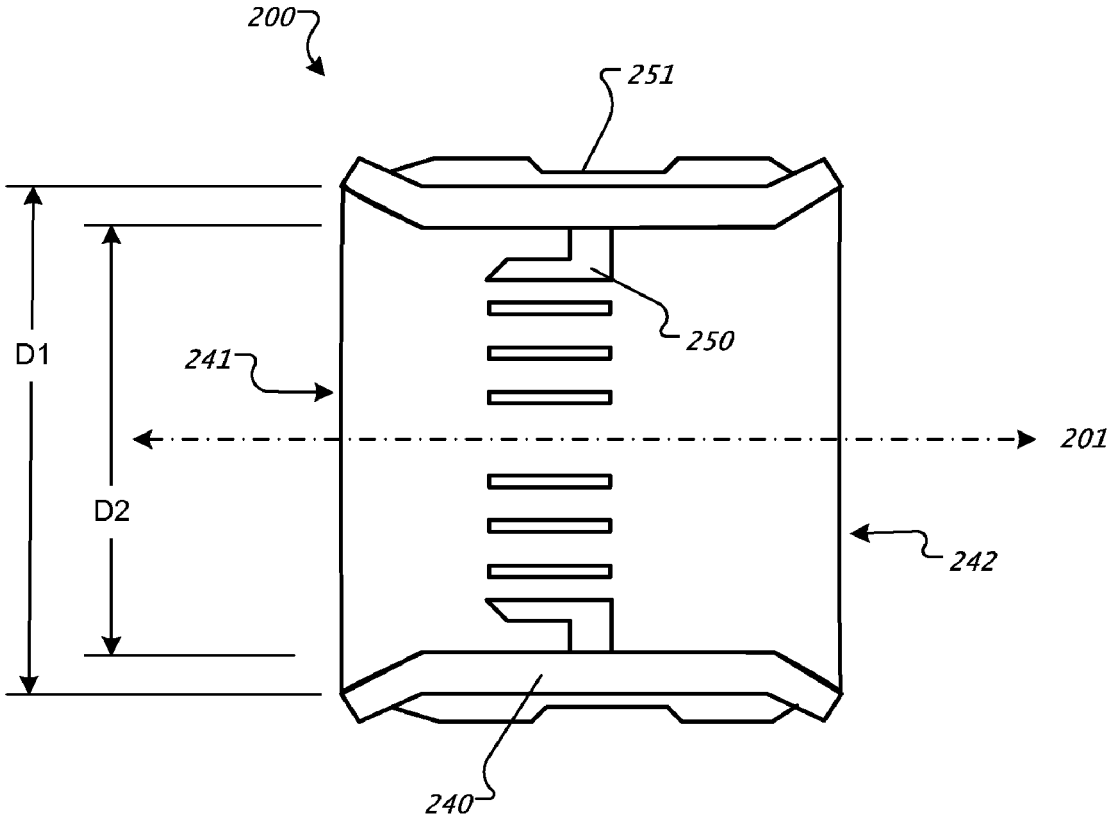
FIG. 15 is a sectional side view of a roller cleaning tool.

FIG. 15 shows a side section view of another implementation of the roller cleaning tool 200. The example shown shares many features with the tools 200 described earlier. In this case, the outer surface of the tube 240 is provided with dumb-bell shaped knurling ribs 251, each gripper knurling rib extending longitudinally, with a lesser diameter portion in the longitudinal center. The knurling provides a readily gripped surface, as well as some additional structural strength. Weight-saving holes may be formed through the outer surface of the tube in view of the additional structural strength provided by the knurling/ribs. In some implementations, the tool 200 is configured in which both longitudinal ends 241, 242 of the tube 240 are of a greater diameter D1 than the main inner diameter D2.

In some examples, the teeth 250 and/or the tube 240 are configured to provide tooth depth adjustment. By varying the depth of the teeth 250, the tool 200 may be (i) used to remove resistant accumulations of filaments or hair in a stepwise manner and/or (ii) used to clear debris from different types of rollers which may have different bristle and/or inner pliable flap diameters, or different roller core diameters.

In one example, a brush roller 100 wound with many filaments may be difficult to clear in a single pass through the tube 200 due to removal resistance of a tight concentration of hair or spooled filaments by the teeth 250. Removal of accumulations of filaments may be facilitated by adjusting the depth of the teeth 250 between cleaning passes. The user may initially adjust the depth of the teeth 250 to a shallower setting such that the teeth 250 only catch an outermost layer of accumulated filaments 33. Thereafter (after cleaning the first collected accumulation from the tubular tool), the user may adjust the depth of the teeth 250 to a deeper setting, and pass the roller 100 through the tubular tool 200 again, catching another layer. The process of adjusting the depth may be repeated until all the debris is removed from the roller 100.

When the tool 200 is used on different rollers (e.g., both brushes of a dual brush cleaner, different brushes on different cleaners), a tooth depth may be set to be as close as possible to the outermost diameter of the core 140 of the roller 100, while still clearing the core 140 when the roller 100 is passed through the tubular tool 200. If the tool 200 is provided for use with two different rollers 100 of one cleaner, the adjusting mechanism may include two detents for the tightest clearance of each kind of roller 100. In order to adjustably attach the teeth 250 to the tubular tool 200, the teeth 250 themselves 250 may be threaded. Alternatively, adjustment of the teeth 250 may be achieved using wedging and friction, or any other suitable technique and/or structure. Each of the implementations depicted in the drawings may include an adjustment mechanism (an adjusting ring, threading, or the like) to change the radial depth of the teeth 250.

Figure 16A:
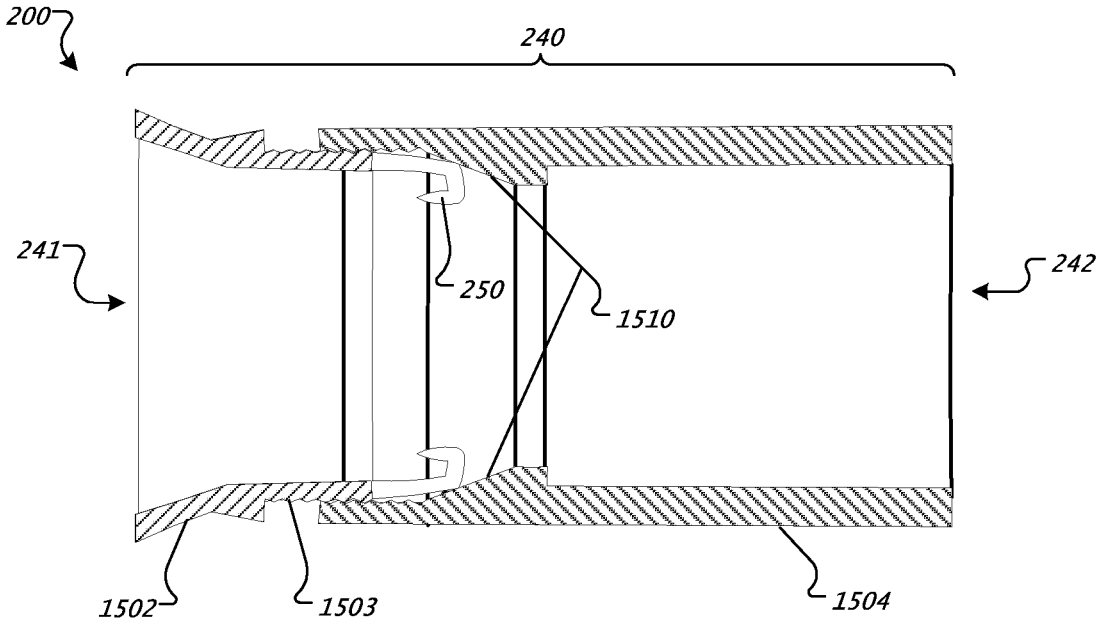
FIG. 16A-16B are sectional side views of a roller cleaning tool.
Figure 16B:
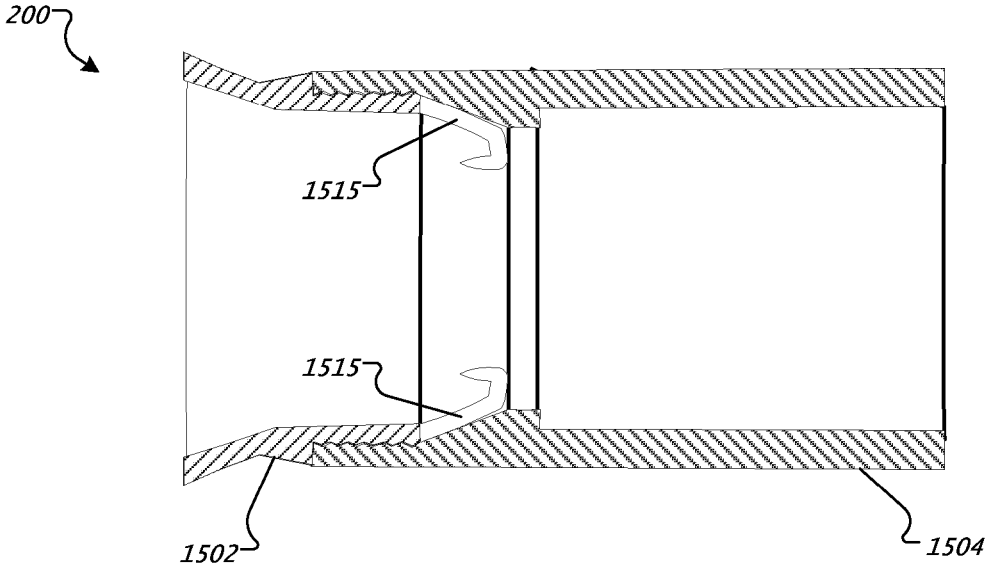

FIGS. 16A-16B shows an exemplary structure for adjusting the tooth depth. The tube 240 includes an inner tube 1502 (including teeth 250) having threads 1503 threadable into an outer tube 1504. Both the inner tube 1502 and the outer tube 1504 have essentially similar inner and outer diameters. At a shallow position shown in FIG. 16A, an internal conic surface 1510 abuts a series of cantilevered teeth 250, permitting each tooth 250 to keep an essentially undeformed profile at the shallower level. The arms 1515 of the cantilevered teeth 250 are formed from durable, fatigue-resistant or softer plastic or elastomer. As the inner tube 1502 is screwed into the outer tube 1504 toward the position shown in FIG. 16B, the internal conic surface 1510 forces the arms 1515 of the teeth 250 to deform, pushing the all of the teeth 250 to a deeper level. This is merely one example of an adjusting mechanism; other mechanisms may be used. In this example, the depth of the teeth 250 is continuously adjustable. However, this mechanism or other mechanisms may render the depth of the teeth 250 adjustable in a stepwise manner with detents or markings to denote particular recommended stopping positions (e.g., for larger or smaller brushes).

Figure 17A:
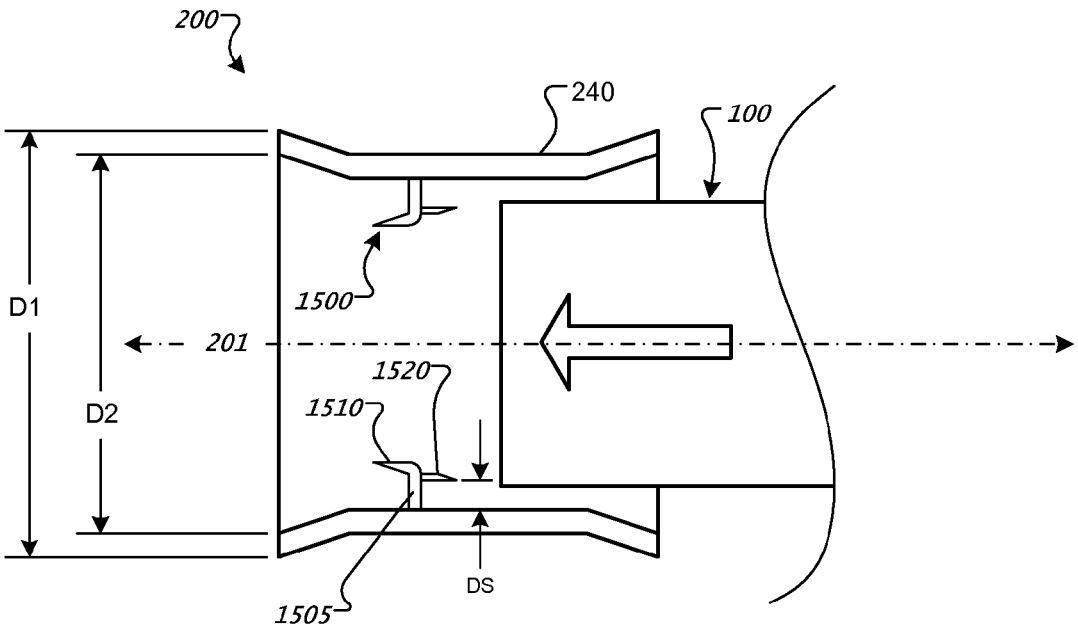
FIG. 17A-17B are sectional side views of a roller cleaning tool cleaning a roller.
Figure 17B:
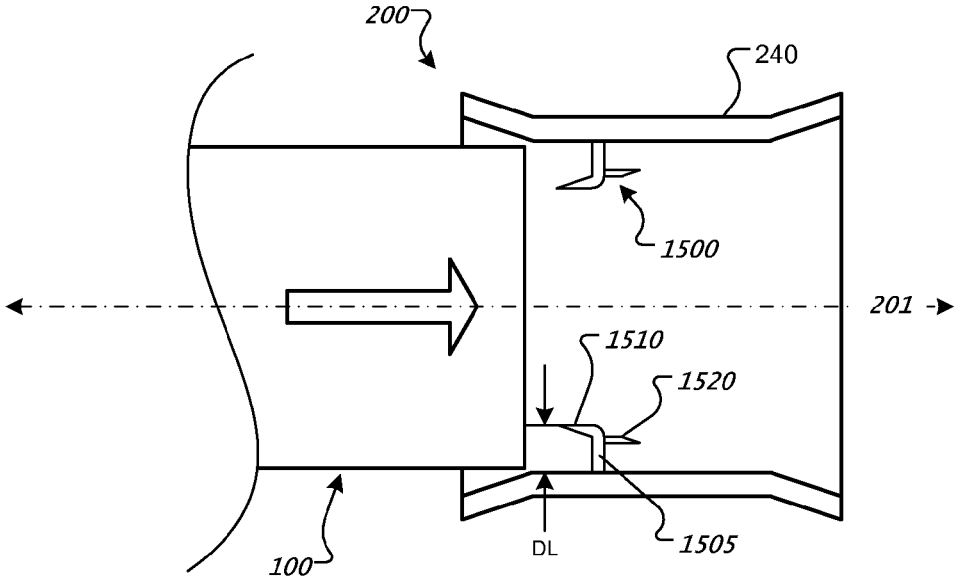

Referring to FIGS. 17A-17B, the tool 200 may also be bi-directional, such that the teeth 250 and inner diameter are arranged to clean a smaller diameter roller inserted from one side (FIG. 17A), and a larger diameter roller from the other side (FIG. 17B). Teeth 1500 are configured with first and second projections, 1510 and 1520 respectively, extending from a stem 1505 in opposite directions along the longitudinal axis 201 of the tube 240. The first projection 1510 is position higher at a distance DL from the interior surface 243 of the tube 240 than the second projection 1520, which is positioned at a distance DS from the interior surface 243 of the tube 240.

Figure 18A:
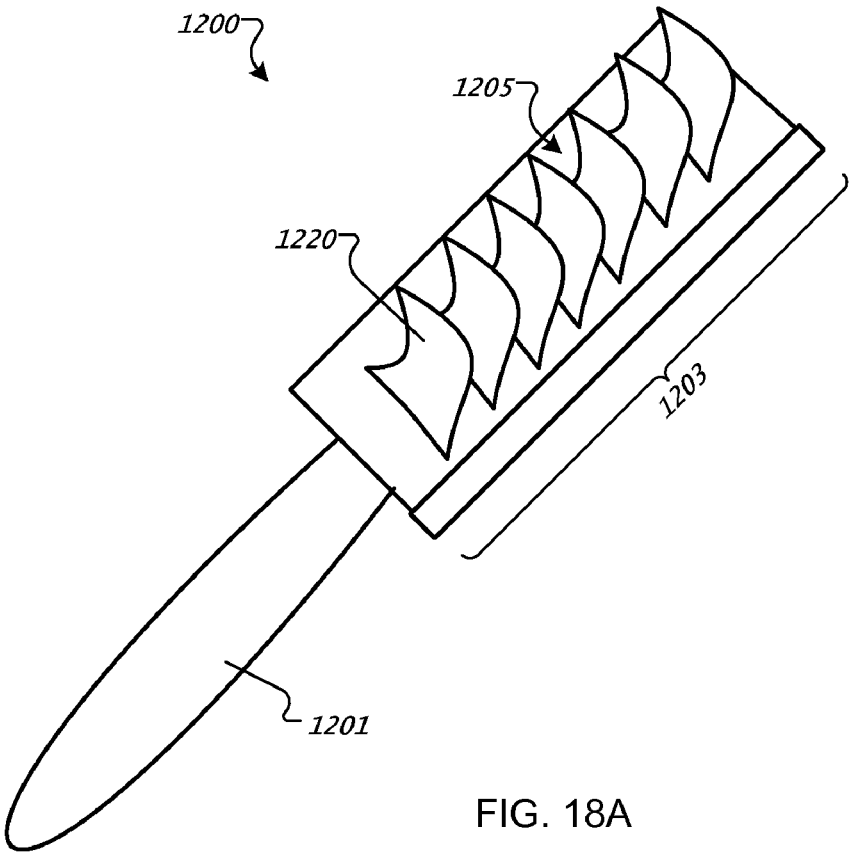
FIG. 18A-18B are front and rear perspective views a dematting rake and slicker brush tool.
Figure 18B:
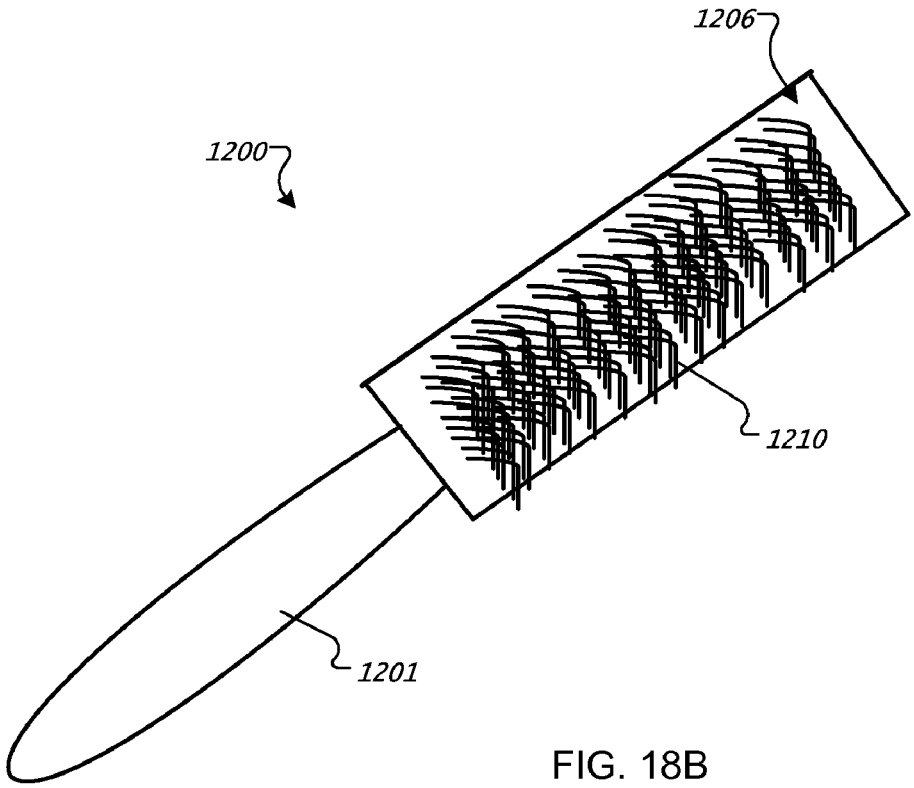

FIGS. 18A-18B illustrate a dematting rake and slicker brush 1200 that may be used to clear debris from the roller 100. The dematting rake/slicker brush 1200 may be include a handle 1201 and a cleaning head 1203 which may have a first (e.g., generally flat) side 1205 and a second (e.g., generally flat) side 1206 opposite the first side 1205. The first side 1205 of the cleaning head 1203 includes a series of dematting blades 1220. The second side 1206 of the cleaning head 1203 includes slicker tines 1210 are arranged to accumulate filaments 33 which may be wound on the roller 100. The operator may use the first side 1205 of the dematting rake/slicker brush 1200 to break up accumulations of filaments 33 on the roller 100, and then use the slicker brush to collect the same, without changing brushes or putting down the robot 10 or removed roller 100. The slicker tines 1210 tend to permit hair or filaments 33 to be removed by flattening the slicker tines 1210 and drawing the slicker brush 1200 along a surface (including the user's hand).

Figure 19A:
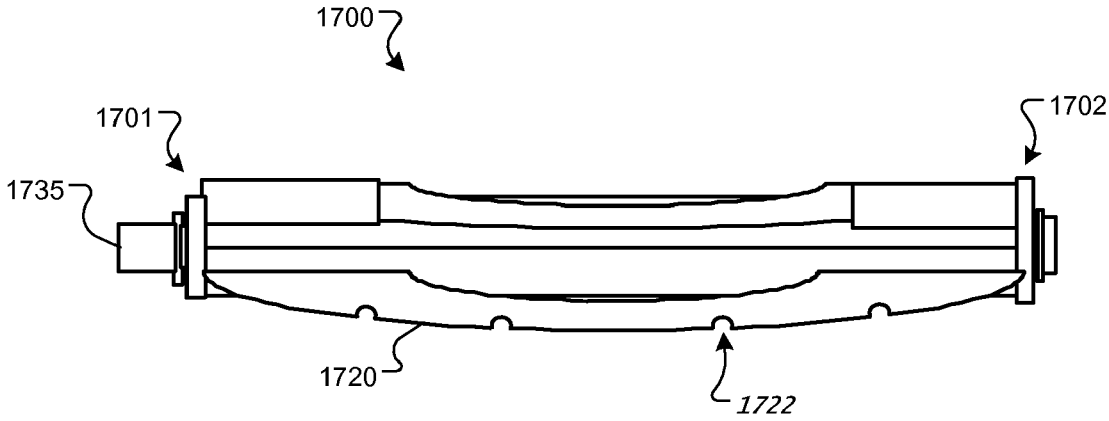
FIG. 19A is a side view of a cleaning roller for a coverage robot or cleaning device.
Figure 19B:
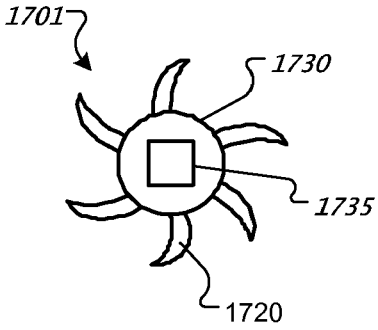
FIG. 19B-19C are end views of a cleaning roller for a coverage robot or cleaning device.
Figure 19C:
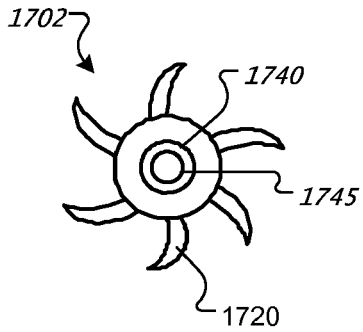

FIGS. 19A-C depicts a smaller roller 1700 having first and second ends 1701 and 1702, respectively, including overmolded polymer/elastomeric flaps 1720 arranged lengthwise along a core 1730 with a slight curvature along the length. These flaps 1720 define notches 1722 (only some shown) to accommodate wire bales. The first end 1701 of the roller 1700 includes a square peg 1735 driven by a cleaning head motor (e.g. via a gearbox). The second end 1702 of the roller 1700 includes a circular or hex-shaped peg 1740, which incorporates a bronze bushing 1745.

The selection of brush may be made in view of the following characteristics, inter alia: a) ability to clean various kinds of debris; b) ability to move swept hair into the bin; c) ability to allow manual cleaning of the brush; d) lowest possible brush bounce.

Figure 20:
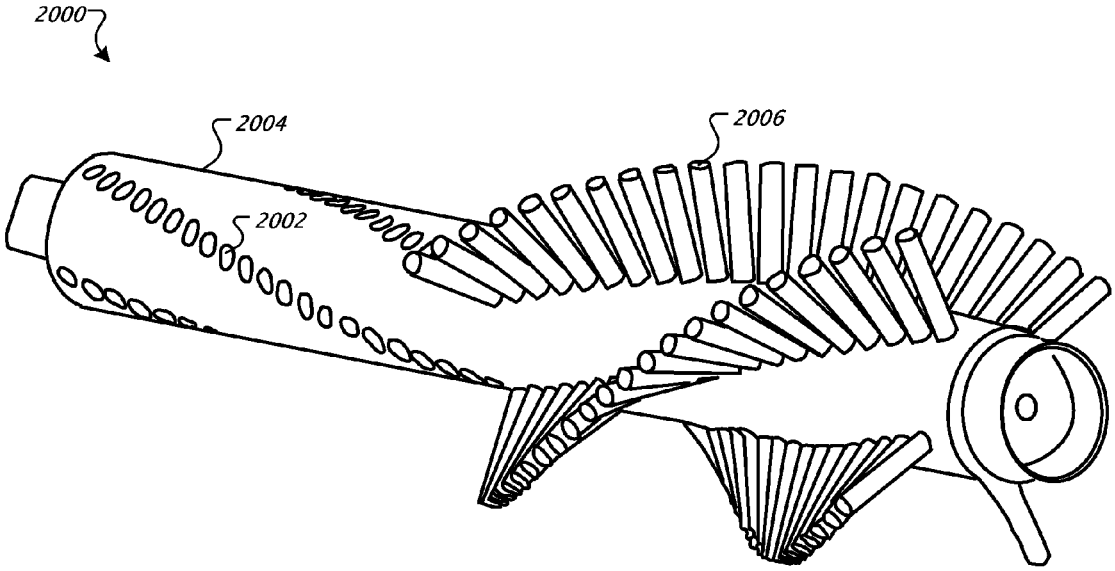
FIG. 20 is a perspective view of a cleaning roller for a coverage robot or cleaning device.

Bristles may assist in picking up hair effectively. In one implementation, a cylindrical brush 2000 as illustrated in FIG. 20 can fling more hair into the bin 50 of the robot 10, trapping less within the bristle structure. The brush 2000 is manufactured by populating long bristle plugs 2002 defined in a solid-core shaft 2004 lengthwise and in a slightly cambered fashion with bristles 2006. The long bristles 2006 allow for better flexing, thereby decreasing power consumption. The brush 2000 may contain three, four, or more curved rows of bristle-plugs 2002 to keep the brush 2000 in constant contact with the work surface, thereby reducing the chordal action of brush and brush bounce.

Figure 21:
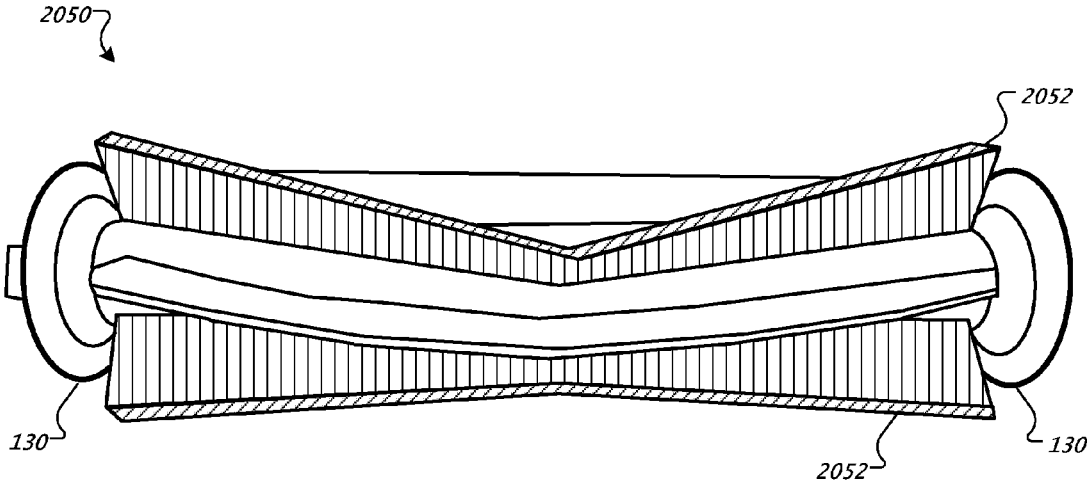
FIG. 21 is a side view of a cleaning roller for a coverage robot or cleaning device.

FIG. 21 depicts a brush 2050 including V-shape bristle rows 2052 configured to act as a scooping device in the direction of rotation. The V-shape bristle rows 2052 (depicted as a bristle envelopes) funnel debris inwards as ramps, increasing the deposition of debris into the bin 50. In this example, the end guards 130 may be easily twisted off the brush 2050.

Figure 22:
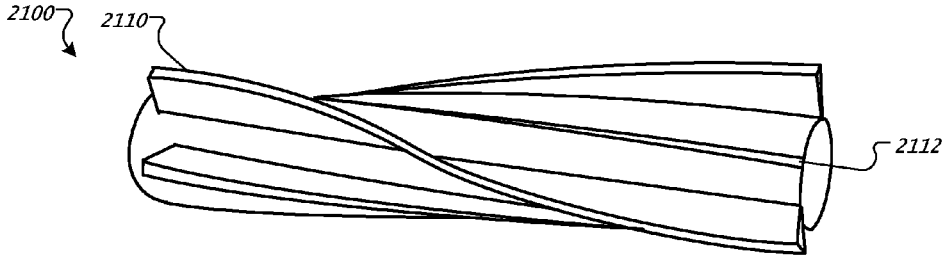
FIG. 22-24 are side views of a cleaning roller for a coverage robot or cleaning device.
Figure 23:
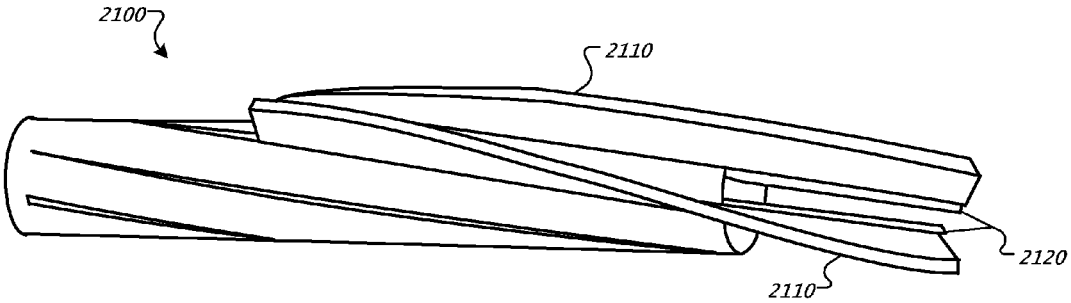
Figure 24:
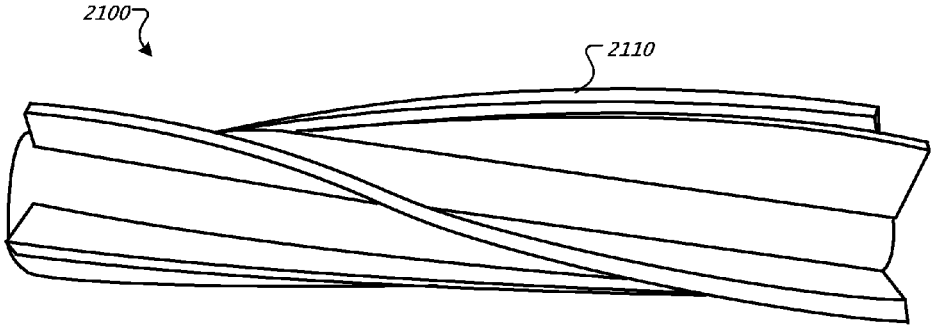

FIGS. 22-24 illustrate a brush roller 2100 including a removable bristle tuft 2110. The brush roller 2100 allows entire rows 2110 of bristles 110 to be removed exposing the core for cleaning and washing, if necessary. The removable rows 2110 of bristles 110 are embedded into an extruded-style backing 2120 (see FIG. 22). This allows the bristle-rows 2110 to be slid into a bristle tuft groove 2112 defined by the brush 2100 and removed for manual cleaning of the brush 2100. The bristle rows 2110 may be disposable after a period of use (see FIG. 21). A gradual single-helix bristle tuft groove 2112 containing a bristle tuft 2110 provides a low bounce condition.

Figure 25A:
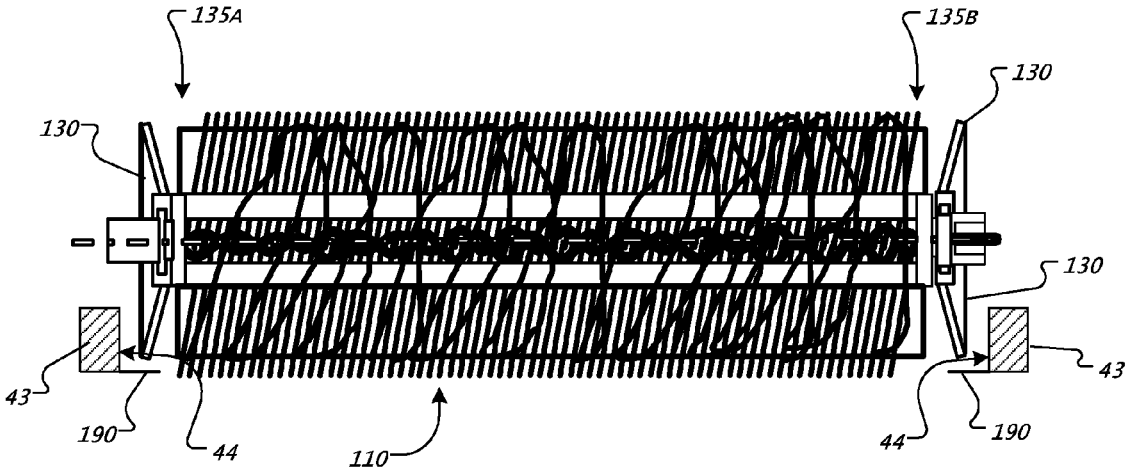
FIG. 25A is a side view of a cleaning roller for a coverage robot and a sectional view of a wire bail assembly.
Figure 25B:
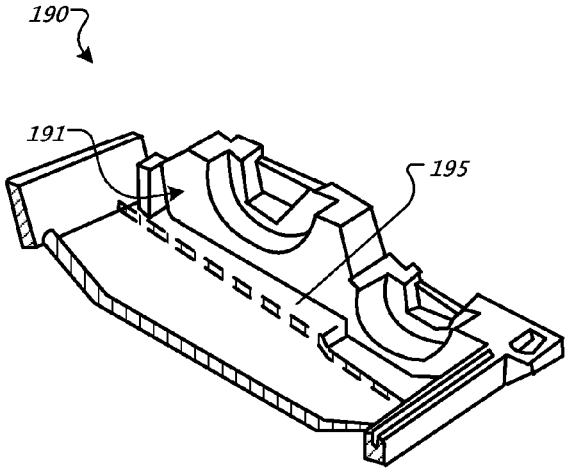
FIG. 25B is a partial perspective view of a wire bail assembly.
Figure 25C:
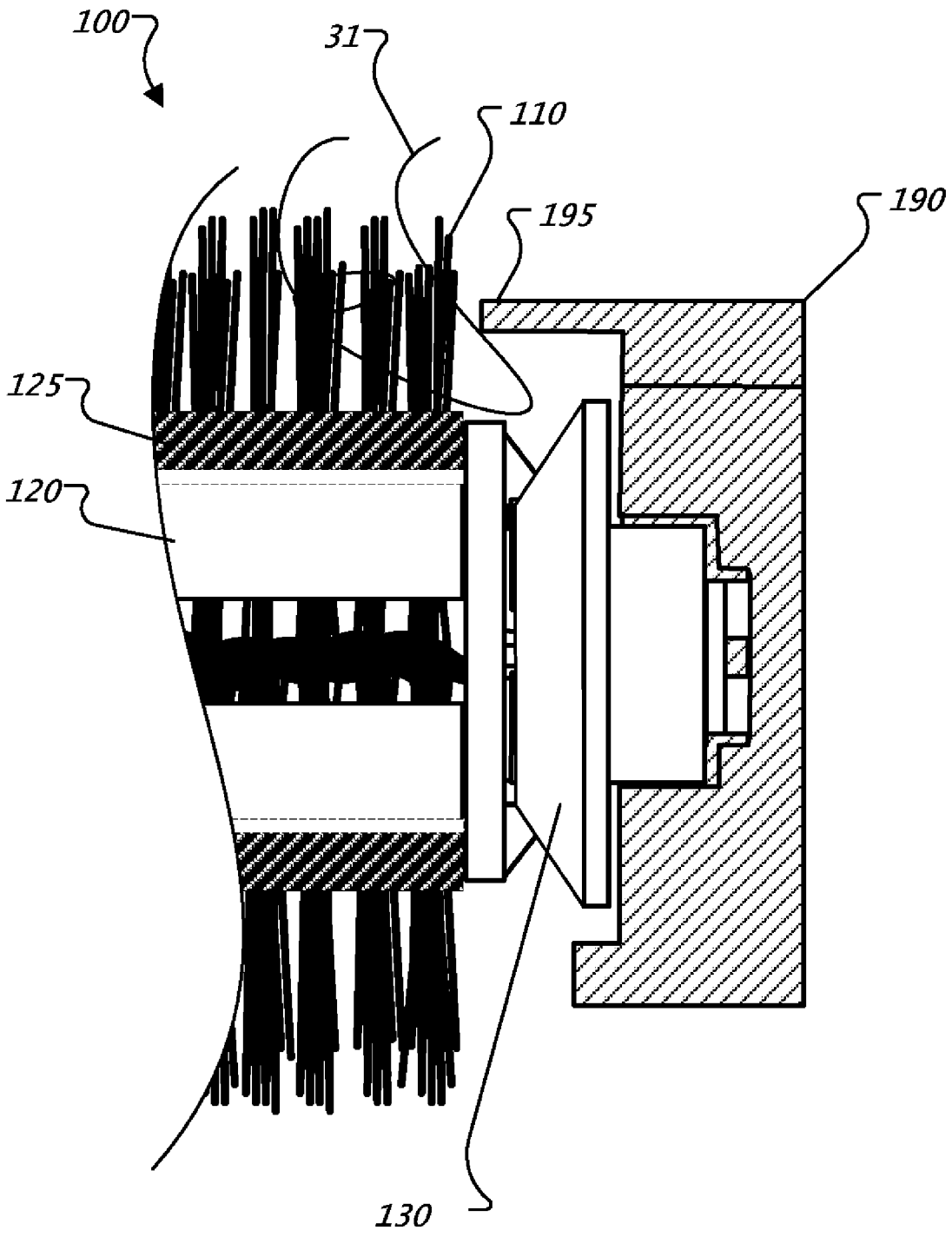
FIG. 25C is a side view of a cleaning roller for a coverage robot and a sectional view of a wire bail assembly.

Referring to FIGS. 25A-25C, the bristles 110 normally pick up hair as the brush 100 spins, any part of hair that extends past the bristles 110 gets wrapped in the brush ends 135A, 135B. While elastomeric-molded-cones or end guards 130 (or other disc shaped parts) may be attached to the ends 135A, 135B of the brush 100 to aid prevention of hair entanglement, the end guards 130 may themselves, via static, or by physical interference grab hair or filaments 33 off carpets and wrap it between cleaning head walls and the end guard 130, creating an entanglement in the bearings 143 and brush ends 135A, 135B. In some examples, the cleaning head assembly 40 includes a wire bale assembly 190 having shelves 195 (e.g. ski-like blades) extending laterally from the inner walls 191 of toward the bristles 110. The shelves 195 may extend along the entire length of a wire bale on the inner walls 191 of the wire bale assembly 190. The bristle diameter is sized so that the bristles 110 extends past the shelf 195. The shelf 195 acts as a spooling guide by directing the entry of hair or filaments 33 into the bristles 110 and away from the brush ends 135A, 135B. The shelf 195 also prevents static built on the sidewalls 44 of the cleaning head chassis 43 from attracting hair. The cone 130 acts as a spool, wrapping on itself any leftover end-length of hair trapped by the bristles 110 and preventing hair or filaments 33 from getting wound into the extremes of the bristle brush ends 135A, 135B. The cone barrier 130 also prevents hair from getting attracted to the sidewalls of the cleaning head assembly 40.

Figure 26:
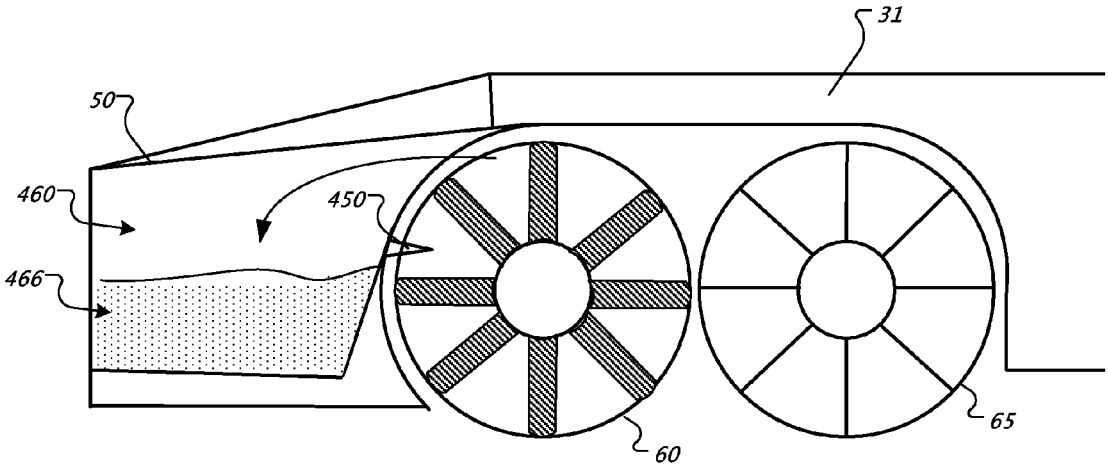
FIG. 26 is a schematic view of a coverage robot with a cleaning bin.

Referring to FIG. 26, the robot 10 may include a bin 400 defining a sweeper bin portion 460 and including a comb or teeth 450 disposed engagingly adjacent the bristle brush 60 and configured to comb hair or debris off the bristle brush 60 as the brush 60 rotates. In some examples, the comb 450 is disposed at the mouth of a cleaning bin 50 of the robot 10. Referring back to FIG. 10, the bin 50 may include a sweeper portion 460 with teeth 450 disposed at a month of the sweeper portion 460 engagingly adjacent the main roller 60 of the cleaning head assembly 40 and a vacuum portion 461 having a squeegee mouth 451.

A spinning roller 100 situated closely to the bristle brush 60 and powered by the same gear-train rolls hair onto itself thus lowering the hair entrapment on the bristle brush 60. The spinning roller 100 may have a sticky surface like that of a lint-roller, or a silicone type hair grabbing surface.

Referring back to FIG. 1B, in some implementations, the robot 10 includes a communication module 90 installed on the bottom of the chassis 31. The communication module 90 provides a communication link between the communication module 1400 on the maintenance station 5100 and the robot 10. The communication module 90, in some instances, includes both an emitter and a detector, and provides an alternative communication path while the robot 10 is located within the maintenance station 5100. In some implementations, the robot 10 includes a roller full sensor assembly 85 installed on either side of and proximate the cleaning head 40. The roller full sensor assembly 85 provides user and system feedback regarding a degree of filament wound about the main brush 65, the secondary brush 60, or both. The roller full sensor assembly 85 includes an emitter 85A for emitting modulated beams and a detector 85B configured to detect the beams. The emitter 85A and detector 86B are positioned on opposite sides of the cleaning head roller 60, 65 and aligned to detect filament wound about the cleaning head roller 60, 65. The roller full sensor assembly 85 includes a signal processing circuit configured to receive and interpret detector output. In some examples, the roller full sensor system 85 detects when the roller 100 has accumulated filaments, when roller effectiveness has declined, or when a bin is full (as disclosed in U.S. Provisional Patent No. 60/741,442, filed Dec. 2, 2005, and herein incorporated by reference in its entirety), trigging automatic clearing of debris from the roller 100 (i.e., the return of the robot to a cleaning station, as described below). In some examples, the robot 10 includes a head cleaning tool 200 configured to clear debris from the roller 100 in response to a timer, a received command from a remote terminal, the roller full sensor system 85, or a button located on the chassis/body 31 of the robot 10.

Once a cleaning cycle is complete, either via the roller full sensor system 85 or visual observation, the user can open the wire bale and pull the roller(s) 60, 65. The roller 60,65 can then be wiped clean off hair and inserted back in place.

Figure 27:
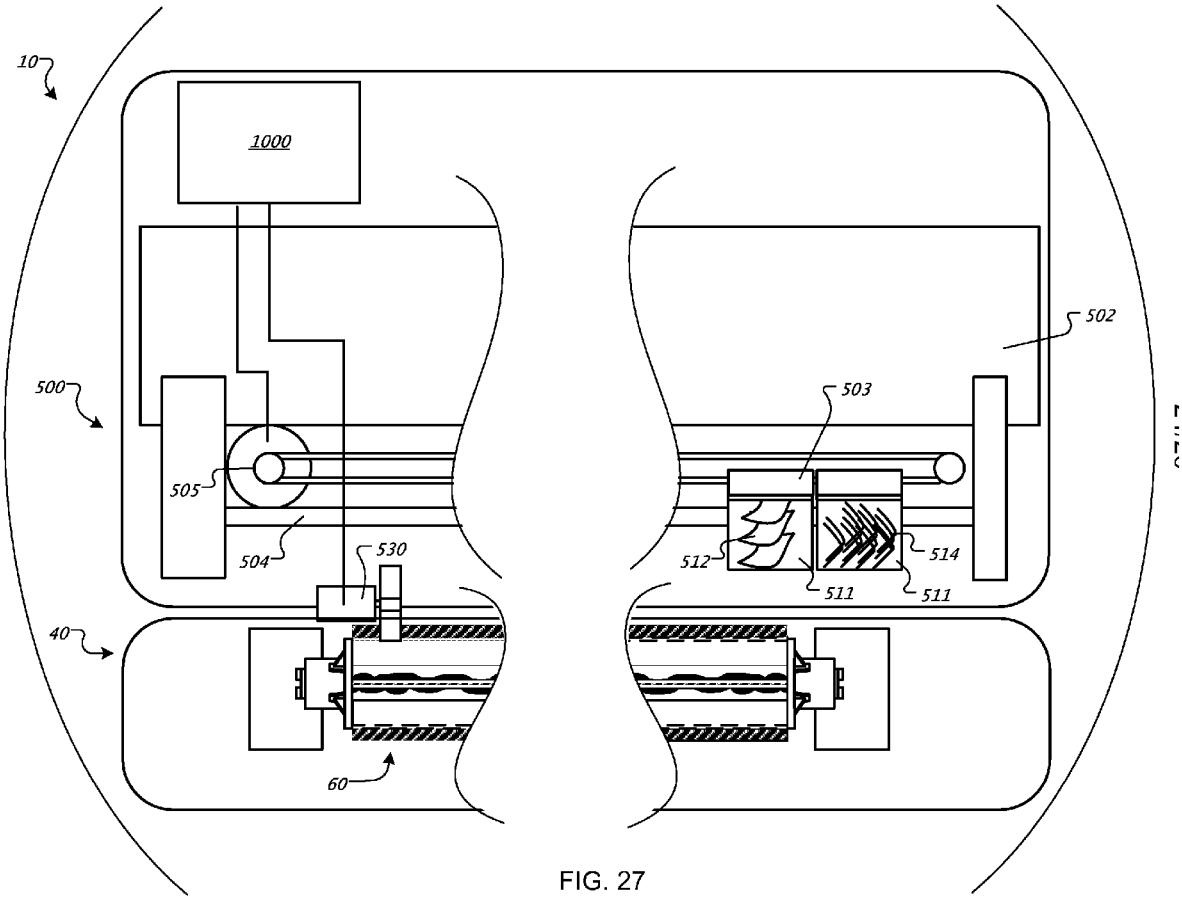
FIG. 27 is a c a coverage robot with a roller cleaning assembly.
Figure 28A:
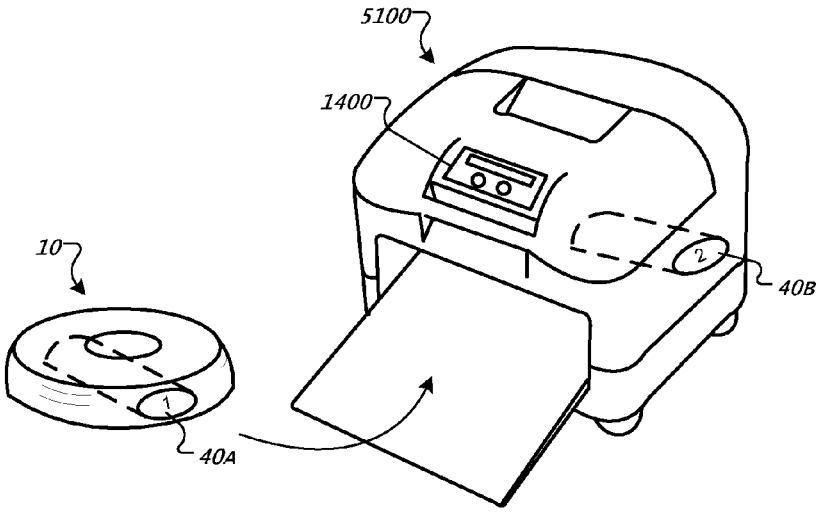
FIG. 28A-28F are schematic views of a coverage robot interacting with a maintenance station for roller cleaning.
Figure 28B:
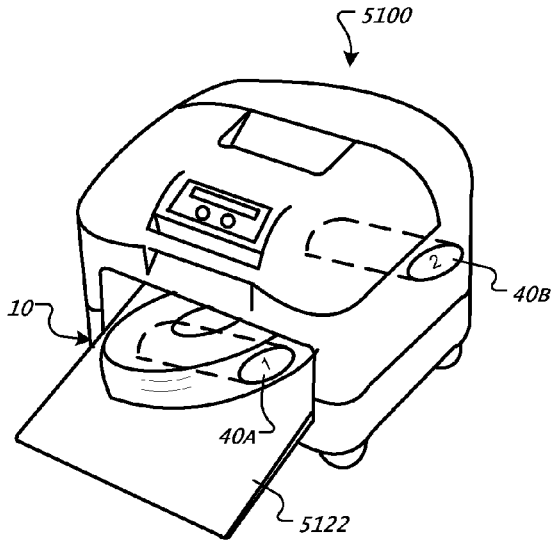
Figure 28C:
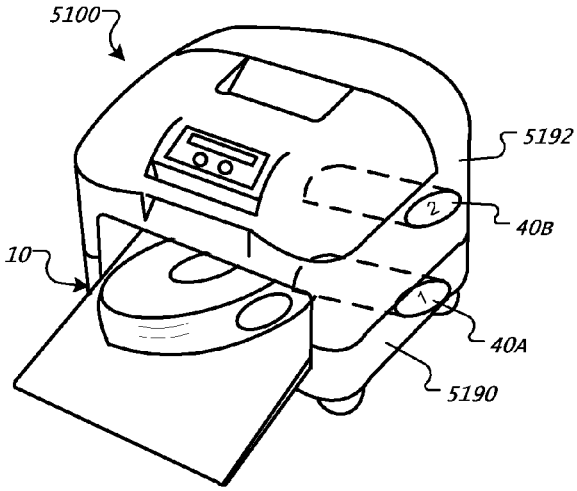
Figure 28D:
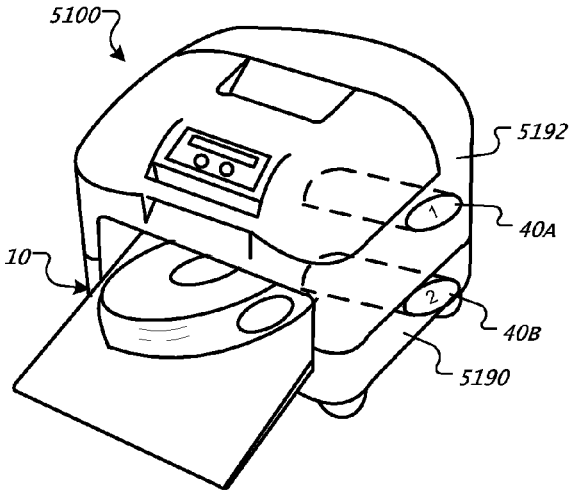
Figure 28E:
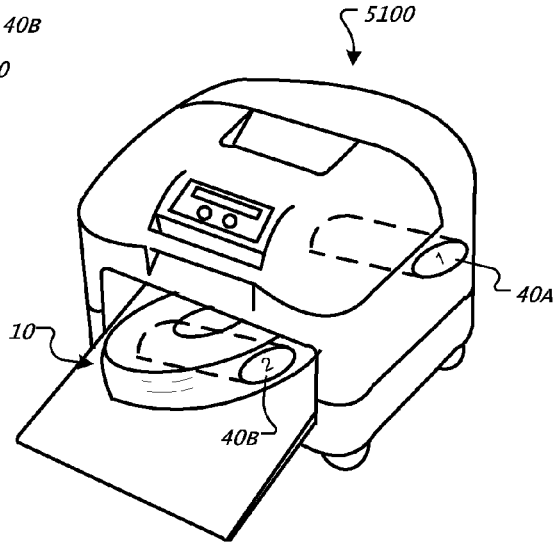
Figure 28F:
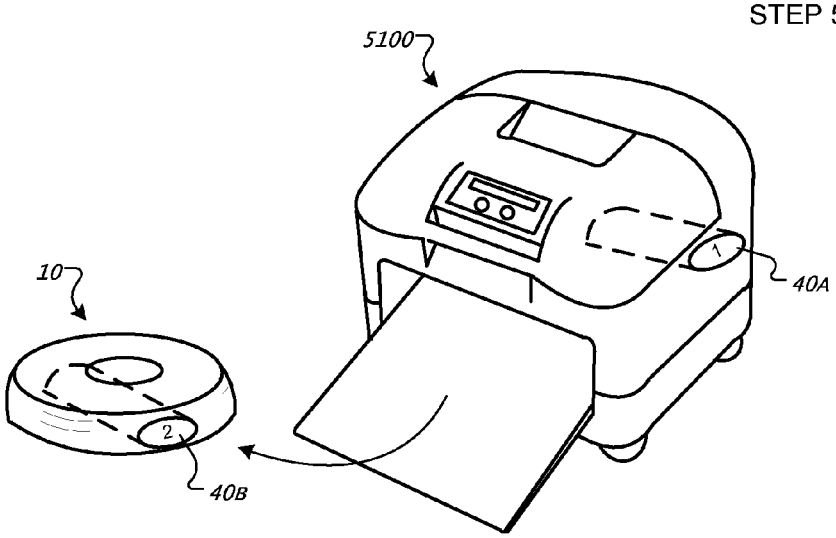

Referring to FIG. 27, in some implementations, the robot 10 includes a roller cleaning assembly 500 controlled by a controller 1000 carried by the robot 10 for automatically cleaning one or more rollers 100 carried by the cleaning head 40. The roller cleaning assembly 500 includes a driven linear slide guide 502 carrying a cleaning head cleaner 510 (e.g. a roller cleaning tool 200 configured as a semi-circular or quarter circular tool) and/or a trimmer 520. In some examples, the driven linear slide guide 502 includes a guide mount or rail follower 503 slidably secured to a shaft or rail 504 and belt driven by a motor 505. A rotator 530 rotates the roller 60, 65 during cleaning.

The cleaning head cleaner 510, in some examples, includes a series of teeth or combs 512 configured to strip filament and debris from a roller 60, 65. In some implementations, the cleaning head cleaner 510 includes one or more semi-tubular or quarter-tubular tools 511 having teeth 512, dematting rakes 514, combs, or slicker combs. The tubular tool 511 may be independently driven by one or more servo, step or other motors 505 and transmissions (which may be a belt, chain, worm, ball screw, spline, rack and pinion, or any other linear motion drive). In some examples, the roller 60, 65 and the cleaning head cleaner 510 are moved relative to one another. In other examples, the cleaning head cleaner 510 is fixed in place while the roller 60, 65 is moved over the cleaning head cleaner 510.

The robot 10 commences a cleaning routine by traversing the cleaning head 510 over the roller 60, 65 such that the teeth 512, dematting rakes 514, combs, or slicker combs, separately or together, cut and remove filaments and debris from the roller 60, 65. In one example, as the cleaning head 510 traverses over the roller 60, 65, the teeth 512 are actuated in a rotating motion to facilitate removal of filaments and debris from the roller 60, 65. In some examples, an interference depth of the teeth 512 into the roller 60, 65 is variable and progressively increases with each subsequent pass of the cleaning head 510.

Referring to FIGS. 28A-F, in some implementations, the robot 10 includes a removable cleaning head cartridge 40, which includes at least one roller 60, 65. When the robot 10 determines that cleaning head cartridge 40 needs servicing (e.g. via the roller full detection system 85 or a timer) the robot 10 initiates a maintenance routine. Step S19-1, illustrated in FIG. 28A, entails the robot 10 approaching the cleaning station 5100 with the aid of navigation system. In one example, the robot 10 navigates to the cleaning station 5100 in response to a received homing signal emitted by the station 5100. In step S19-2, illustrated in FIG. 28B, the robot 10 docks with the station 5100. In the example shown, the robot 10 maneuvers up a ramp 5122 and is secured in place by a locking assembly 5260. In step S19-3, illustrated in FIG. 28C, the dirty cartridge 40A is automatically unloaded from the robot 10, either by the robot 10 or the cleaning station 5100, into a transfer bay 5190 in the cleaning station 5100. In some examples, the dirty cartridge 40A is manually unloaded from the robot 10 and placed in the transfer bay 5190 by a user. In other examples, the dirty cartridge 40A is automatically unloaded from the robot 10, but manually placed in the transfer bay 5190 by the user. In step S19-4, illustrated in FIG. 28D, the cleaning station 5100 exchanges a clean cartridge 40B in a cleaning bay 5192 with the dirty cartridge 40A in the transfer bay 5190. In step S19-5, illustrated in FIG. 28E, the cleaning station 5100 automatically transfers the clean cartridge 40B into the robot 10. In some examples, the user manually transfers the clean cartridge 40B from the transfer bay 5190 into the robot 10. In step S19-6, illustrated in FIG. 28F, the robot 10 exits the station 5100 and may continue a cleaning mission. Meanwhile, the dirty cartridge 40A in the cleaning bay 5192 is cleaned. The maintenance station 5100 includes a roller cleaning assembly 500 for cleanly the roller 100. The automated cleaning process may be slower than by hand, require less power, clean more thoroughly, and perform quietly. The robot 10 continues cleaning rooms while the cleaning station 5100 cleans the dirty cartridge 40A using cleaning tools 510 (instead of a supplementary vacuum), by taking many slow passes.

Other details and features combinable with those described herein may be found in the following U.S. patent applications filed concurrently herewith, entitled "COVERAGE ROBOTS AND ASSOCIATED CLEANING BINS" having assigned Ser. No. 11/751,267; and "REMOVING DEBRIS FROM CLEANING ROBOTS" having assigned Ser. No. 11/751,470, the entire contents of the aforementioned applications are hereby incorporated by reference.

A number of implementations have been described. Nevertheless, it will be understood that various modifications may be made without departing from the spirit and scope of the disclosure. Although reference has been made to cleaning and/or vacuuming robots by way of examples, it is nonetheless understood that any of the features set forth in the above-discussed implementations also apply to any suitable type of robot or mobile machine which employs a rotating brush to sweep dirt or debris. For example, a hand-operated or automated vacuum-cleaner can equivalently employ the filament-removal features described herein, such as a roller having sweeping bristles and inner pliable flaps, the various tools, etc. Accordingly, other implementations are within the scope of the following claims.

What is claimed is:

1. A coverage robot comprising:
a chassis;
a drive system mounted on the chassis and configured to maneuver the robot; and
a cleaning assembly carried by the chassis and comprising:
a cleaning assembly housing; and
at least one driven flapper brush rotatably coupled to the cleaning assembly housing and comprising:
an elongated core having an outer surface and end mounting features extending beyond axial ends of the outer surface and defining a central longitudinal axis of rotation;
a compliant flap extending radially outward from the core to sweep a floor surface as the roller is driven to rotate, the flap configured to prevent errant filaments from spooling tightly about the core to aid subsequent removal of the filaments; and
axial end guards mounted on the core adjacent the ends of the outer core surface and configured to prevent spooled filaments from traversing axially from the outer core surface onto the mounting features, wherein the end guard is removable from each longitudinal end of the core.

2. The coverage robot of claim 1 wherein the flapper brush further comprises multiple floor cleaning bristles extending radially outward from the core, wherein a diameter of the compliant flap about the core is less than a diameter of the bristles about the core.

3. The coverage robot of claim 1 wherein the end guard is compliant, elastically deforming for removing accumulated errant filaments off of the flaps.

4. A coverage robot comprising:
a chassis;
a drive system mounted on the chassis and configured to maneuver the robot; and
a cleaning assembly carried by the chassis and comprising:
a cleaning assembly housing; and
at least one driven sweeper brush rotatably coupled to the cleaning assembly housing and comprising:
an elongated core having an outer surface and end mounting features extending beyond axial ends of the outer surface and defining a central longitudinal axis of rotation;
multiple floor cleaning bristles extending radially outward from the core; and
axial end guards mounted on the core adjacent the ends of the outer core surface and configured to prevent spooled filaments from traversing axially from the outer core surface onto the mounting features, wherein the end guard is removable from each longitudinal end of the core.

5. The coverage robot of claim 4 wherein the bristles are disposed about the core in multiple rows, each row forming a substantially V-shaped groove configuration along the core.

6. The coverage robot of claim 4 wherein the end guard is compliant, elastically deforming for removing accumulated errant filaments off of the bristles.

7. A coverage robot comprising:
a chassis;
a drive system mounted on the chassis and configured to maneuver the robot;
a controller carried by the chassis;
a cleaning assembly carried by the chassis and comprising:
a cleaning assembly housing; and
at least one driven cleaning roller rotatably coupled to the cleaning assembly housing; and
a roller cleaning tool carried by the chassis and comprising:
a body configured to longitudinally traverse the roller; and
protrusions extending outward from the body and configured to remove debris from the roller while passing over the cleaning roller.

8. The coverage robot of claim 7 wherein the roller cleaning tool further comprises a linear drive configured to drive the cleaning tool across the cleaning roller.

9. The coverage robot of claim 7 wherein the roller cleaning tool is substantially tubular.

10. The coverage robot of claim 7 wherein the roller cleaning tool includes a depth adjustor configured to control a depth of interference of the housing into the cleaning roller.

11. A robot roller maintenance system comprising:
a coverage robot comprising:
a chassis;
a drive system mounted on the chassis and configured to maneuver the robot;
a controller carried by the chassis;
a cleaning assembly carried by the chassis and comprising:
a cleaning assembly housing; and
at least one driven cleaning roller rotatably coupled to the cleaning assembly housing and comprising:
a rotatable, elongated core with end mounting features defining a central longitudinal axis of rotation;
multiple floor cleaning bristles extending radially outward from the core; and
at least one compliant flap extending radially outward from the core and configured to prevent errant filaments from spooling tightly about the core; and
a filament stripping tool for the roller comprising:
a substantially tubular housing defining first and second openings configured to receive the cleaning roller; and
protrusions extending from an interior surface of the housing toward a central longitudinal axis defined by the housing to a depth that interferes with the compliant flap, the protrusion configured to remove accumulated filaments spooled about the roller passing through the housing.

12. The robot roller maintenance system of claim 11 wherein at least two of the protrusions of the filament stripping tool extend toward the central longitudinal axis at different heights.

13. The robot roller maintenance system of claim 11 wherein at least one of the first and second openings of the tubular housing is sized larger than a diameter of the cleaning roller and larger than a diameter of a middle region between the first and second openings.

14. The robot roller maintenance system of claim 11 wherein a deforming portion of the housing is sized smaller than a diameter of the cleaning roller to deform peripheral longitudinal edges of the roller as the cleaning roller passes through the housing.

15. The robot roller maintenance system of claim 14 wherein the deforming portion of the filament stripping tool is sized smaller than a diameter of the bristles and a diameter of the compliant flap about the cleaning roller, wherein the bristles and compliant flap elastically deform to comply with the deforming portion of the housing when the cleaning roller passes through the housing.

16. The robot roller maintenance system of claim 11 wherein the filament stripping tool further comprises a trailing comb disposed on the interior surface of the housing and including tines configured to remove debris from a cleaning roller passing through the housing.

17. The robot roller maintenance system of claim 11 wherein the filament stripping tool further comprises a guide ring disposed on the interior surface of the housing and configured to support the housing substantially concentrically on a cleaning roller while permitting rotation of the housing relative to the cleaning roller.

18. The robot roller maintenance system of claim 11 wherein the filament stripping tool further comprises a filament blade disposed on the housing.

19. The robot roller maintenance system of claim 11 wherein the filament stripping tool further comprises a fuzz comb extending from the housing in the longitudinal direction and comprising multiple rows of tines.

* * * * *